US010020002B2

(12) United States Patent
Chebiyyam et al.

(10) Patent No.: US 10,020,002 B2
(45) Date of Patent: Jul. 10, 2018

(54) GAIN PARAMETER ESTIMATION BASED ON ENERGY SATURATION AND SIGNAL SCALING

(71) Applicant: QUALCOMM Incorporated, San Diego, CA (US)

(72) Inventors: Venkata Subrahmanyam Chandra Sekhar Chebiyyam, San Diego, CA (US); Venkatraman S. Atti, San Diego, CA (US); Vivek Rajendran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 15/083,633

(22) Filed: Mar. 29, 2016

(65) Prior Publication Data

US 2016/0293177 A1 Oct. 6, 2016

Related U.S. Application Data

(60) Provisional application No. 62/143,156, filed on Apr. 5, 2015.

(51) Int. Cl.

| | |
|---|---|
| ***G10L 21/00*** | (2013.01) |
| ***G10L 19/26*** | (2013.01) |
| ***G10L 19/06*** | (2013.01) |
| ***G10L 19/032*** | (2013.01) |
| ***G10L 19/02*** | (2013.01) |
| ***G10L 19/005*** | (2013.01) |
| ***G10L 21/038*** | (2013.01) |

(52) U.S. Cl.
CPC ..... *G10L 19/26* (2013.01); *G10L 19/005* (2013.01); *G10L 19/0208* (2013.01); *G10L 19/032* (2013.01); *G10L 19/06* (2013.01); *G10L 21/038* (2013.01)

(58) Field of Classification Search
USPC ..... 704/225, 227, 228, 500–504
See application file for complete search history.

(56) References Cited

U.S. PATENT DOCUMENTS 9,361,901 B2 * 6/2016 LeBlanc
2007/0276889 A1 11/2007 Gayer et al.
(Continued)

OTHER PUBLICATIONS

3GPP TS 26.445: "Universal Mobile Telecommunications System (UMTS), LTE, Codec for Enhanced Voice Services (EVS), Detailed algorithmic description (version 12.1.0 Release 12)", Technical Specification, European Telecommunications Standards Institute (ETSI), 650, Route Des Lucioles, F-06921 Sophia-Anti Polis, France, vol. 3GPP SA 4, No. V12.1.0, Mar. 1, 2015 (Mar. 1, 2015), pp. 654, XP014248384, title section 5.2.6.1 figure 44. (2 parts).
(Continued)

*Primary Examiner* — Leonard Saint Cyr
(74) *Attorney, Agent, or Firm* — Toler Law Group, P.C.

(57) ABSTRACT

A device including gain shape circuitry configured to determine a number of sub-frames of multiple sub-frames that are saturated, the multiple sub-frames included in a frame of a high band audio signal. The device also includes gain frame circuitry configured to determine, based on the number of sub-frames that are saturated, a gain frame parameter corresponding to the frame.

47 Claims, 8 Drawing Sheets

(56) References Cited

U.S. PATENT DOCUMENTS

2009/0281800 A1* 11/2009 LeBlanc ..... G10L 21/0208
704/224
2009/0287496 A1* 11/2009 Thyssen ..... H03G 7/007
704/500
2014/0229171 A1 8/2014 Atti et al.

OTHER PUBLICATIONS

3GPP TS 26.445: "Universal Mobile Telecommunications System (UMTS), LTE, Codec for Enhanced Voice Services (EVS), Detailed algorithmic description (version 12.3.0 Release 12)", Technical Specification, European Telecommunications Standards Institute (ETSI), 650, Route Des Lucioles, F-06921 Sophia-Anti Polis, France, vol. 3GPP SA 4, No. V12.3.0, Sep. 1, 2015 (Sep. 1, 2015), pp. 658, XP014265319, title section 5.2.6.1 figure 44. (2 parts).
International Search Report and Written Opinion—PCT/US2016/025041—ISA/EPO—dated Jul. 1, 2016.
Bessette B., et al., "Universal Speech/Audio Coding Using Hybrid ACELP/TCX Techniques", IEEE International Conference on Acoustics, Speech, and Signal Processing, 2005, vol. 3, Jan. 1, 2005, XP055022141, DOI: 10.1109/ICASSP.2005.1415706, ISBN: 978-0-78-038874-1, pp. 301-304.

* cited by examiner

GAIN PARAMETER ESTIMATION BASED ON ENERGY SATURATION AND SIGNAL SCALING

I. CROSS REFERENCE TO RELATED APPLICATIONS

The present application claims the benefit of U.S. Provisional Patent Application No. 62/143,156, entitled "GAIN PARAMETER ESTIMATION BASED ON ENERGY SATURATION AND SIGNAL SCALING," filed Apr. 5, 2015, which is expressly incorporated by reference herein in its entirety.

II. FIELD

The present disclosure is generally related to gain parameter estimation.

III. DESCRIPTION OF RELATED ART

Transmission of audio signals (e.g., human voice content, such as speech) by digital techniques is widespread. Bandwidth extension (BWE) is a methodology that enables transmitting audio using reduced network bandwidth and achieving high-quality reconstruction of the transmitted audio. According to BWE extension schemes, an input audio signal may be separated into a low band signal and a high band signal. The low band signal may be encoded for transmission. To save space, instead of encoding the high band signal for transmission, an encoder may determine parameters associated with the high band signal and transmit the parameters instead. A receiver may use the high band parameters to reconstruct the high band signal.

Examples of high band parameters include gain parameters, such as a gain frame parameter, a gain shape parameter, or a combination thereof. Thus, a device may include an encoder that analyzes a speech frame to estimate one or more gain parameters, such as gain frame, gain shape, or a combination thereof. To determine the one or more gain parameters, the encoder may determine an energy value, such as an energy value associated with a high band portion of the speech frame. The determined energy value may then be used to estimate the one or more gain parameters.

In some implementations, the energy value may become saturated during one or more calculations to determine the input speech energy. For example, in fixed-point computation systems, saturation may occur if a number of bits needed or used to represent the energy value exceeds a total number of bits available to store the calculated energy value. As an example, if the encoder is limited to storing and processing 32-bit quantities, then the energy value may be saturated if the energy value occupies more than 32 bits. If the energy value is saturated, gain parameters that are determined from the energy value may have lower values than their actual values, which may lead to attenuation and loss in dynamic range of a high-energy audio signal. Loss in dynamic range of the audio signal may degrade the audio quality, for example, in case of high-level audio signals (e.g., −16 decibel overload (dBov)) where the fricative sounds (e.g., /sh/, /ss/) exhibit unnatural level compression.

IV. SUMMARY

In a particular aspect, a device includes a gain shape circuitry and a gain frame circuitry. The gain shape circuitry is configured to determine a number of sub-frames of multiple sub-frames that are saturated. The multiple sub-frames are included in a frame of a high band audio signal. The gain frame circuitry is configured to determine, based on the number of sub-frames that are saturated, a gain frame parameter corresponding to the frame.

In another particular aspect, a method includes receiving, at an encoder, a high band audio signal that includes a frame, the frame including multiple sub-frames. The method also includes determining a number of sub-frames of the multiple sub-frames that are saturated. The method further includes determining, based on the number of sub-frames that are saturated, a gain frame parameter corresponding to the frame.

In another particular aspect, a computer-readable storage device storing instructions that, when executed by a processor, cause the processor to perform operations including determining a number of sub-frames of multiple sub-frames that are saturated. The multiple sub-frames are included in a frame of a high band audio signal. The operations further include determining, based on the number of sub-frames that are saturated, a gain frame parameter corresponding to the frame.

In another particular aspect, an apparatus includes means for receiving a high band audio signal that includes a frame, the frame including multiple sub-frames. The apparatus also includes means for determining a number of sub-frames of the multiple sub-frames that are saturated. The apparatus further includes means for determining a gain frame parameter corresponding to the frame. The gain frame parameter is determined based on the number of sub-frames that are saturated.

In another particular aspect, a method includes receiving, at an encoder, a high band audio signal. The method further includes scaling the high band audio signal to generate a scaled high band audio signal. The method also includes determining a gain parameter based on the scaled high band audio signal.

Other aspects, advantages, and features of the present disclosure will become apparent after review of the application, including the following sections: Brief Description of the Drawings, Detailed Description, and the Claims.

V. BRIEF DESCRIPTION OF THE DRAWINGS

Figure 4:
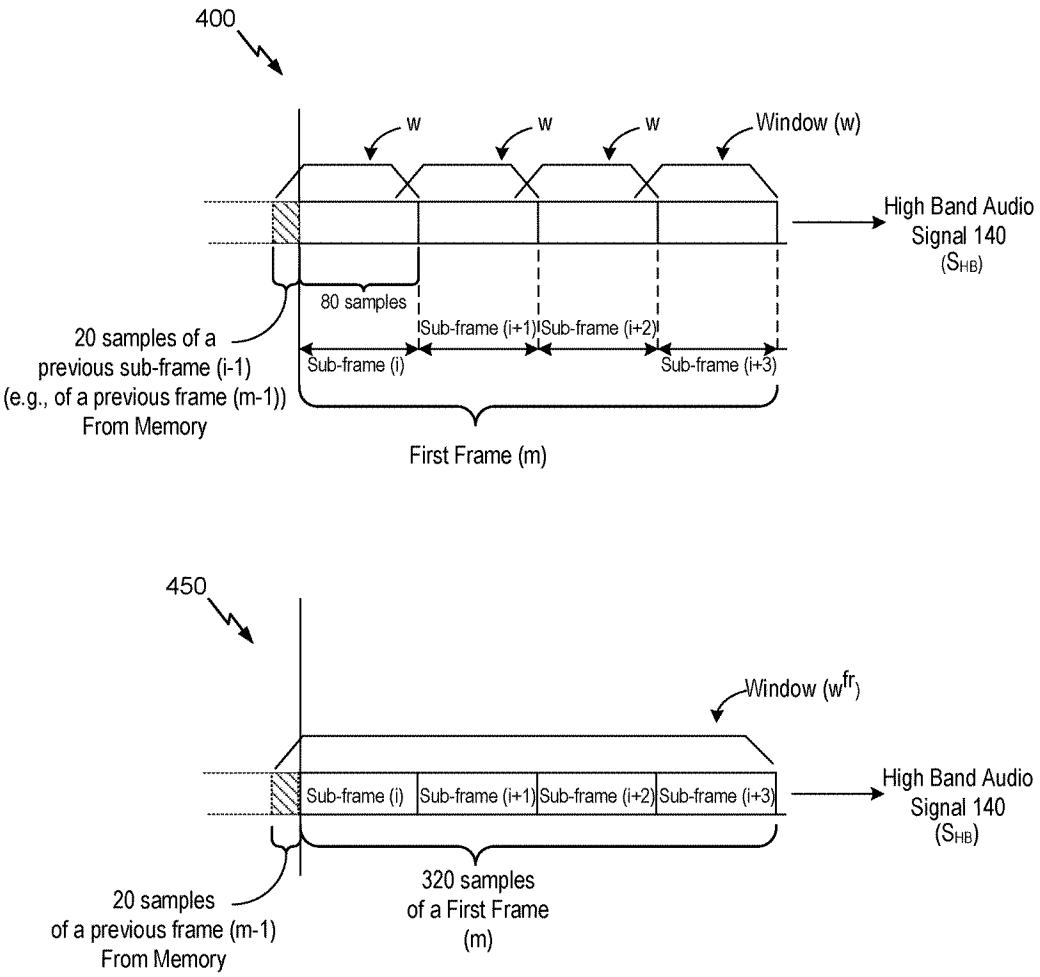
Figure 5:
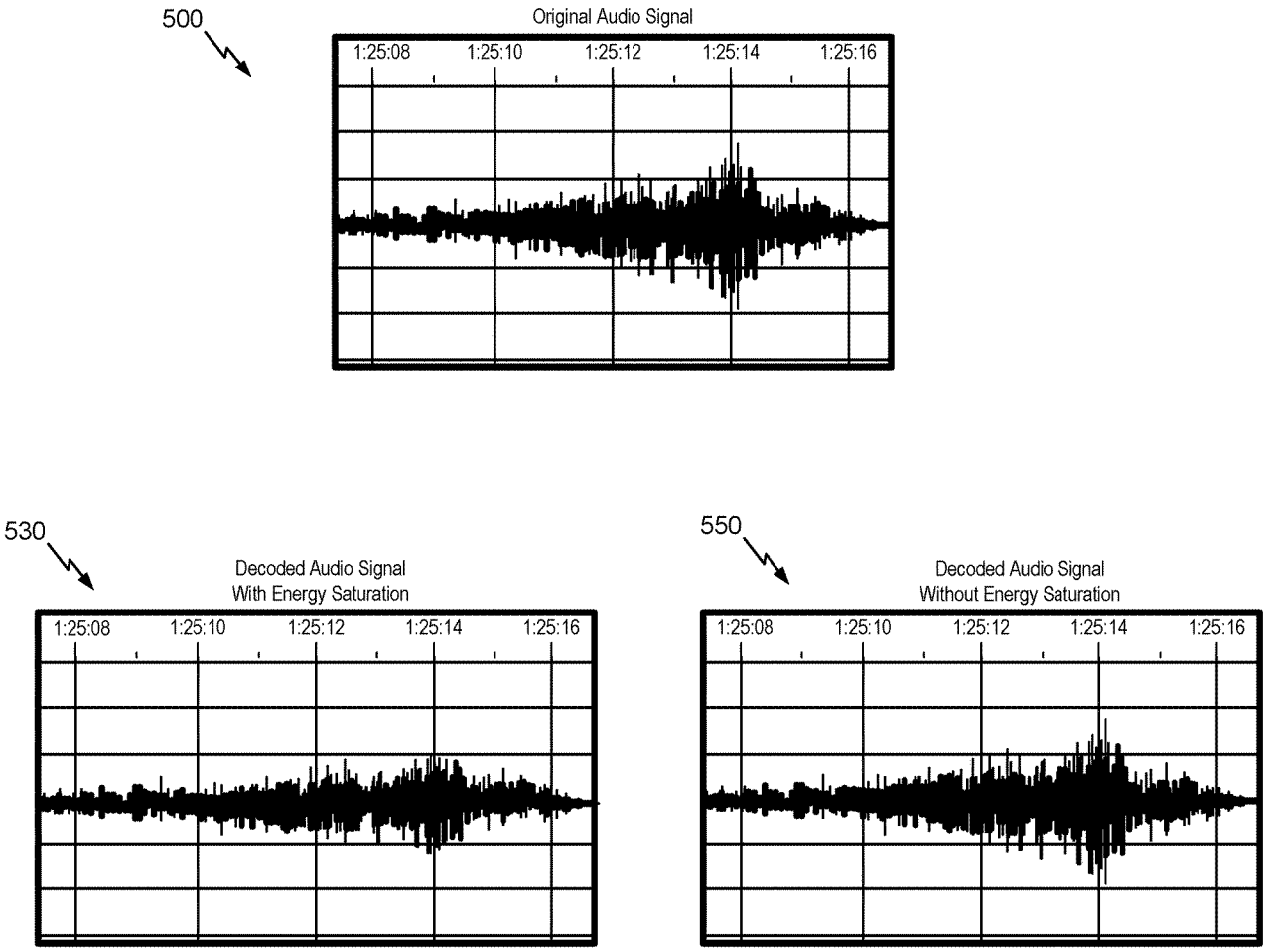
Figure 6:
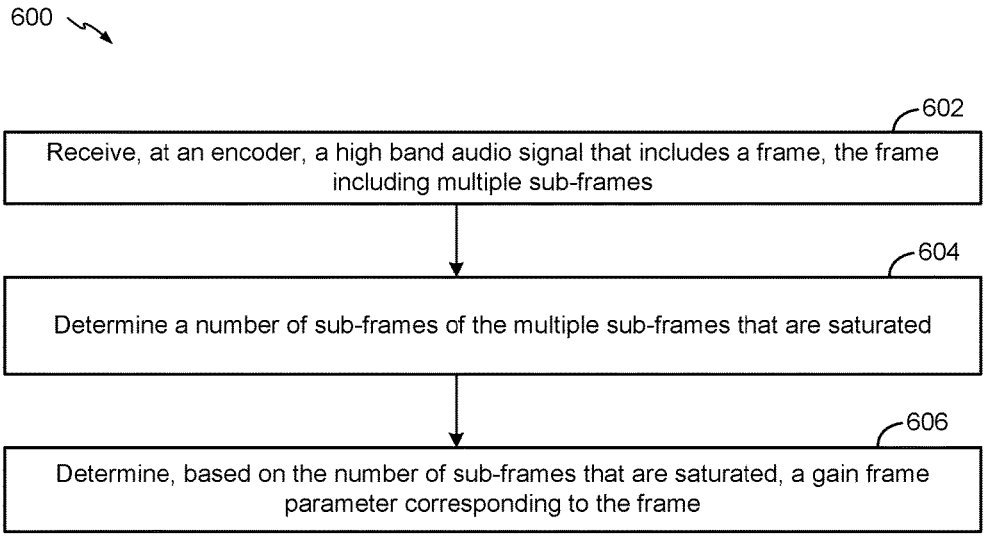
Figure 7:
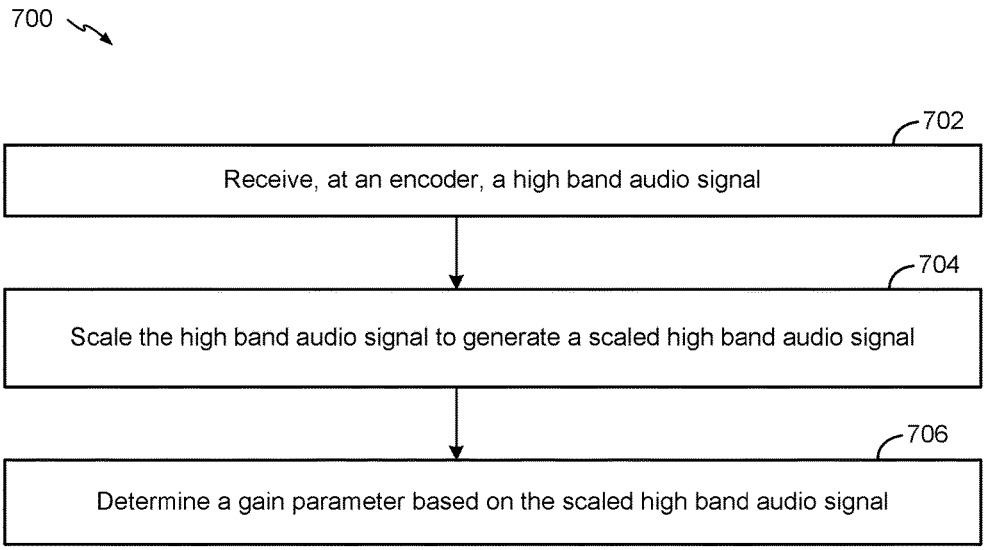
Figure 8:
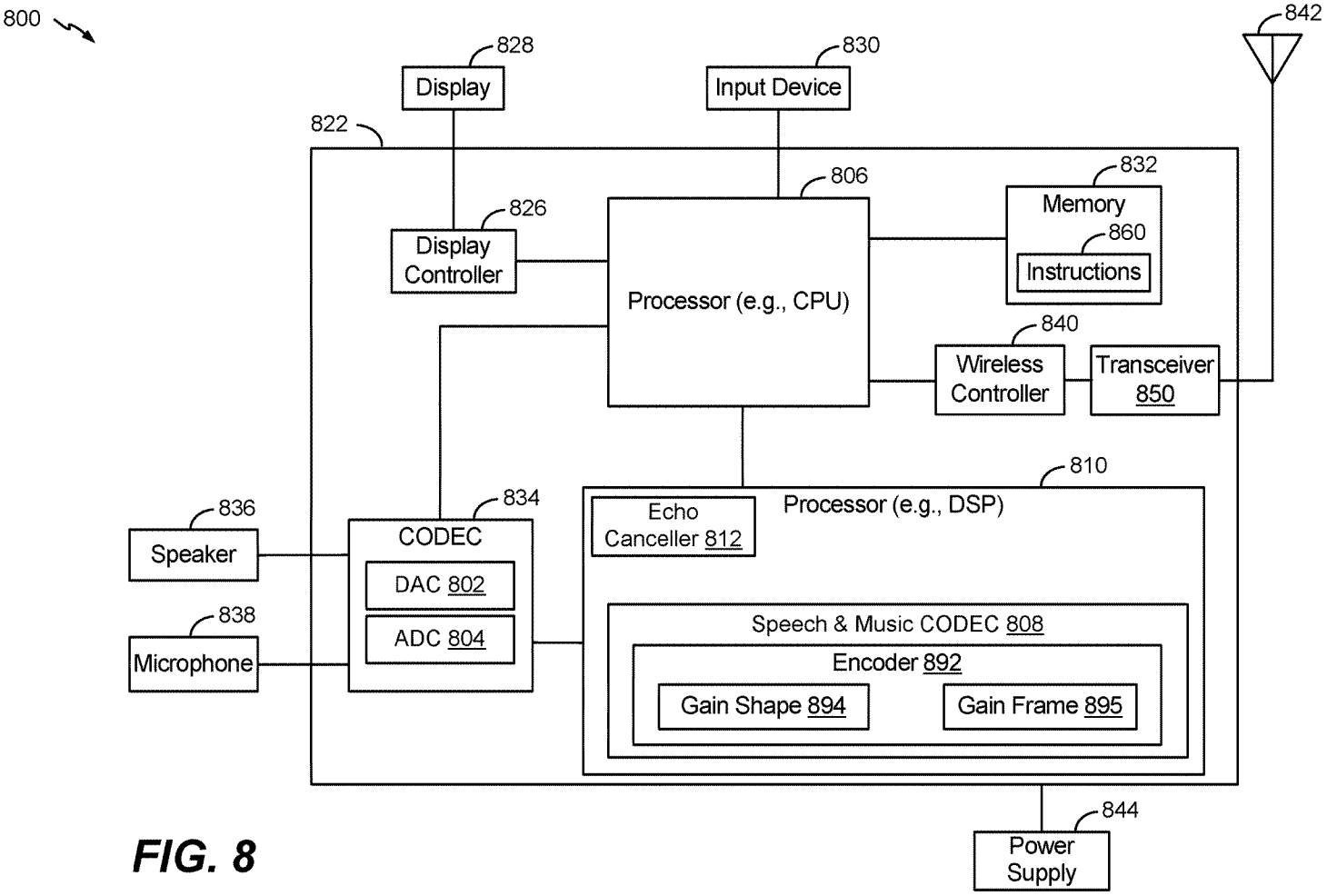
Figure 9:
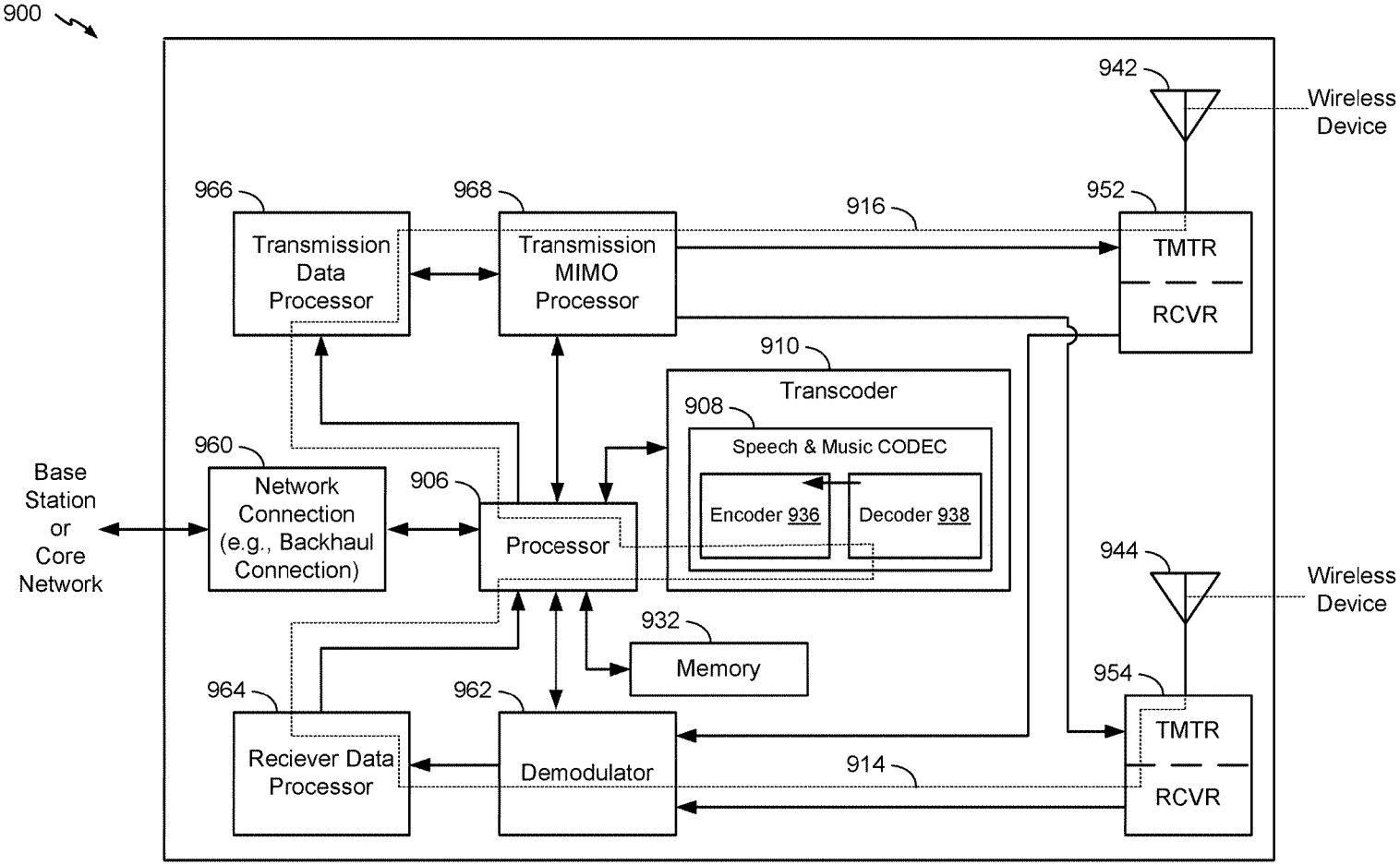

FIG. 4 includes graphs illustrating examples of determining energy values associated with an audio signal;

FIG. 5 includes graphs illustrating examples of audio signals;

FIG. 6 is a flow chart illustrating an example of a method of operating an encoder;

FIG. 7 is a flow chart illustrating another example of a method of operating an encoder;

FIG. 8 is a block diagram of a particular illustrative example of a device that is operable to detect band limited content; and FIG. 9 is a block diagram of a particular illustrative aspect of a base station that is operable to select an encoder.

VI. DETAILED DESCRIPTION

Particular aspects of the present disclosure are described below with reference to the drawings. In the description, common features are designated by common reference numbers. As used herein, various terminology is used for the purpose of describing particular implementations only and is not intended to be limiting. For example, the singular forms "a," "an," and "the" are intended to include the plural forms as well, unless the context clearly indicates otherwise. It may be further understood that the terms "comprises" and "comprising" may be used interchangeably with "includes" or "including". Additionally, it will be understood that the term "wherein" may be used interchangeably with "where". As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to a grouping of one or more elements, and the term "plurality" refers to multiple elements.

In the present disclosure, a high band signal may be scaled and the scaled high band signal may be used to determine one or more gain parameters. The one or more gain parameters may include a gain shape parameter, a gain frame parameter, or a combination thereof, as illustrative, non-limiting examples. The high band signal may be scaled before, or as part of, performing an energy calculation to determine the one or more gain parameters. The gain shape parameter may be determined on a per-sub-frame basis and may be associated with a power ratio of the high band signal and a synthesized high band signal (e.g., a synthesized version of the high band signal). The gain frame parameter may be determined on a per-frame basis and may be associated with the power ratio of the high band signal and a synthesized high band signal.

To illustrate, a high band signal may include a frame having multiple sub-frames. An estimated gain shape may be determined for each of the multiple sub-frames. To determine the gain shape parameter for each sub-frame, an energy value of the (unscaled) high band signal may be generated to determine whether the sub-frame is saturated. If a particular sub-frame is saturated, the high band signal corresponding to the sub-frame may be scaled by a first predetermined value (e.g., a first scaling factor) to generate a first scaled high band signal. For example, the particular sub-frame may be scaled down by a factor of two, as an illustrative, non-limiting example. For each sub-frame that is identified as being saturated, the gain shape parameter may be determined using the first scaled high band signal for the sub-frame.

To determine the gain frame parameter for the frame, the high band signal may be scaled to generate a second high band signal. In one example, the high band may be scaled based on a number of sub-frames of the frame that were identified as being saturated during the gain shape estimation. To illustrate, the number of sub-frames identified as being saturated may be used to determine a scaling factor that is applied to the high band signal. In another example, the high band signal may be scaled by a second predetermined value (e.g., a second scaling factor), such as a factor of 2 or a factor of 8, as illustrative, non-limiting examples. As another example, the high band signal may be iteratively scaled until its corresponding energy value is no longer saturated. The gain frame parameter may be determined using the second scaled high band signal.

One particular advantage provided by at least one of the disclosed aspects is that the high band signal may be scaled prior to performing the energy calculation. Scaling the high band energy signal may avoid saturation of the high band signal and may reduce degradation of audio quality (associated with the high band signal) caused by attenuation. For example, scaling down by factor(s) of 2 (or 4, 8, etc.) may reduce the energy value of a frame or sub-frame to a quantity that can be presented using an available number of bits used to store the calculated energy value at an encoder.

Figure 1:
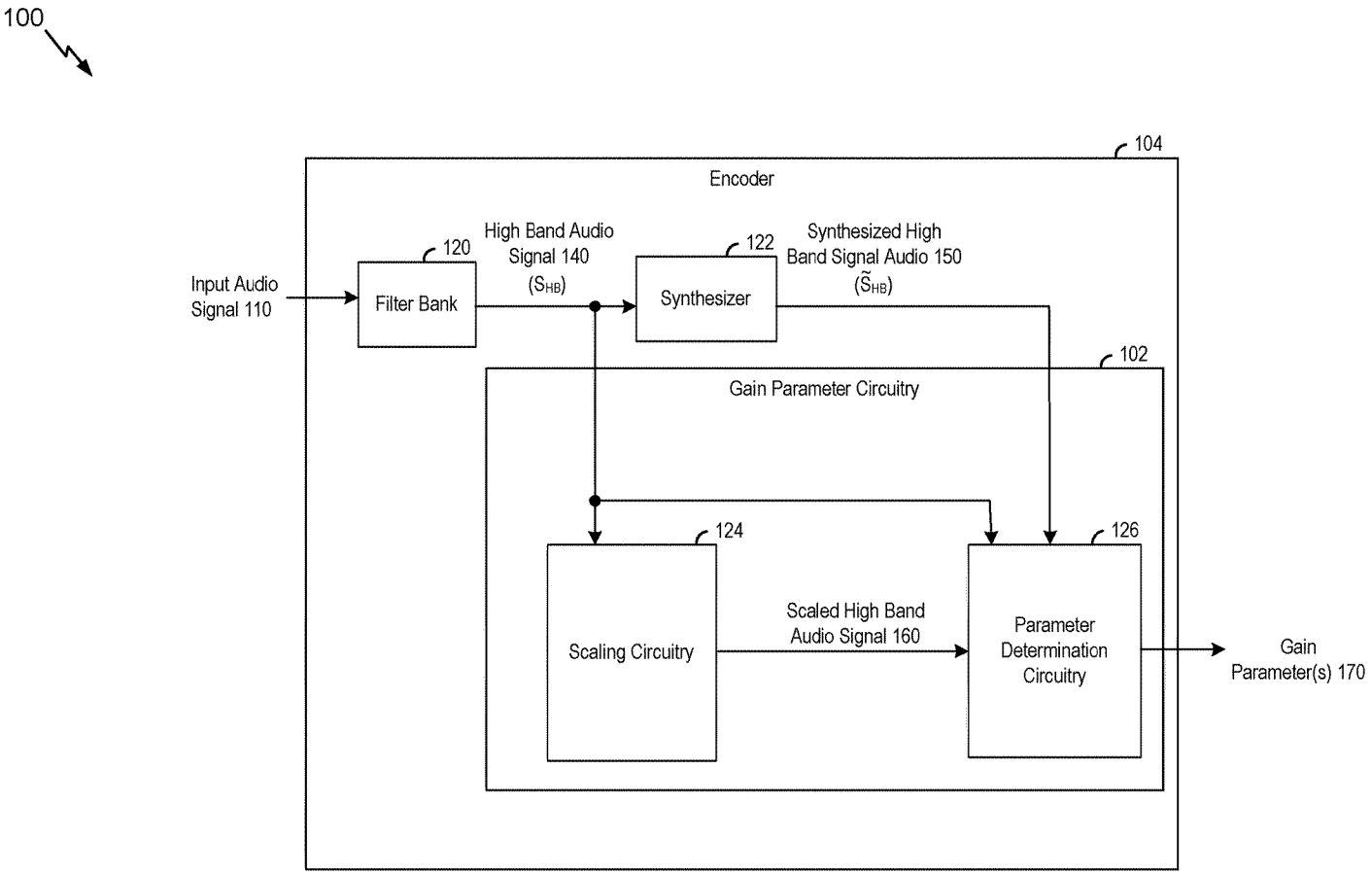
FIG. 1 is a block diagram of an example of a system that is configured to determine one or more gain parameters.

Referring to FIG. 1, a particular illustrative aspect of a system operable to generate one or more gain parameters is disclosed and generally designated 100. The system 100 may include an encoder 104 that is configured to receive an input audio signal 110. In some implementations, the encoder 104 may be configured to operate in accordance with one or more protocols/standards, such as in accordance (or compliance) with a 3rd Generation Partnership Project (3GPP) enhanced voice services (EVS) protocol/standard, as an illustrative, non-limiting example.

The encoder 104 may be configured to encode an input audio signal 110 (e.g., speech data). For example, the encoder 104 may be configured to analyze the input audio signal 110 to extract one or more parameters and may quantize the parameters into binary representation, e.g., into a set of bits or a binary data packet. In some implementations, the encoder 104 may include a model based high band encoder, such as a super wideband (SWB) harmonic bandwidth extension model based high band encoder. In a particular implementation, a super wideband may correspond to a frequency range of 0 Hertz (Hz) to 16 kilohertz (kHz). In another particular implementation, the super wideband may correspond to a frequency range of 0 Hertz (Hz) to 14.4 kHz. In some implementations, the encoder 104 may include a wideband encoder or a fullband encoder, as illustrative, non-limiting examples. In a particular implementation, the wideband encoder may correspond to a frequency range of 0 Hertz (Hz) to 8 kHz and the fullband encoder may correspond to a frequency range of 0 Hertz (Hz) to 20 kHz. The encoder may be configured to estimate, quantize, and transmit one or more gain parameters 170. For example, the one or more gain parameters 170 may include one or more sub-frame gains referred to as "gain shape" parameters, one or more overall frame gains referred to as "gain frame" parameters, or a combination thereof. The one or more gain shape parameters may be generated and used by the encoder 104 to control a temporal variation of energy (e.g., power) of a synthesized high band speech signal at a resolution that is based on a number of sub-frames per frame associated with the input audio signal 110.

To illustrate, the encoder 104 may be configured to compress, to divide, or a combination thereof, a speech signal into blocks of time to generate frames. In some implementations, the encoder 104 may be configured to receive a speech signal on a frame-by-frame basis. The duration of each block of time (or "frame") may be selected to be short enough that the spectral envelope of the signal may be expected to remain relatively stationary. In some implementations, the system 100 may include multiple encoders, such as a first encoder configured to encode speech content and a second encoder configured to encode non-speech content, such as music content.

The encoder 104 may include a filter bank 120, a synthesizer 122 (e.g., a synthesis module), and gain parameter circuitry 102 (e.g., gain parameter logic or a gain parameter module). The filter bank 120 may include one or more filters. The filter bank 120 may be configured to receive the input audio signal 110. The filter bank 120 may filter the input audio signal 110 into multiple portions based on frequency. For example, the filter bank 120 may generate a low band audio signal (not shown) and a high band audio signal ($S_{HB}$) 140. In one example, if the input audio signal 110 is super wideband, the low band audio signal may correspond to 0-8 kHz and the high band audio signal ($S_{HB}$) 140 may correspond to 8-16 kHz. In another example, the low band audio signal may correspond to 0-6.4 kHz and the high band audio signal ($S_{HB}$) 140 may correspond to 6.4-14.4 kHz The high band audio signal ($S_{HB}$) 140 may be associated with a high band speech signal. The high band audio signal ($S_{HB}$) 140 may include a frame that has multiple sub-frames, such as four sub-frames, as an illustrative, non-limiting example. In some implementations, the filter bank 120 may generate more than two outputs.

The synthesizer 122 may be configured to receive the high band audio signal ($S_{HB}$) 140 (or a processed version thereof) and to generate a synthesized high band audio signal ($\tilde{S}_{HB}$) 150 (e.g., a synthesized signal) based at least in part on the high band audio signal ($S_{HB}$) 140. Generation of the synthesized high band audio signal ($\tilde{S}_{HB}$) 150 is described further herein with reference to FIG. 3. In some implementations, the synthesized high band audio signal ($\tilde{S}_{HB}$) 150 may be scaled by a scaling factor (e.g., a scaling factor of 2, as an illustrative, non-limiting example) to generate a scaled synthesized high band audio signal. The scaled synthesized high band audio signal may be provided to the gain parameter circuitry 102.

The gain parameter circuitry 102 may be configured to receive the high band audio signal ($S_{HB}$) 140 and the synthesized high band audio signal ($\tilde{S}_{HB}$) 150 and to generate the one or more gain parameters 170. The one or more gain parameters 170 may include a gain shape parameter, a gain frame parameter, or a combination thereof. The gain shape parameter may be determined on a per-sub-frame basis and the gain frame parameter may be determined on a per-frame basis. Generation of the gain shape parameters and the gain frame parameter is described further with reference to FIG. 2.

The gain parameter circuitry 102 may include scaling circuitry 124 (e.g., scaling logic or a scaling module) and parameter determination circuitry 126 (e.g., parameter determination or a parameter determination module). The scaling circuitry 124 may be configured to scale the high band audio signal ($S_{HB}$) 140 to generate a scaled high band audio signal 160. For example, the high band audio signal ($S_{HB}$) 140 may be scaled down by a scaling value, such as a scaling value of 2, 4, or 8, as illustrative, non-limiting examples. Although the scaling value has been described as a power of two (e.g. $2^1$, $2^2$, $2^3$, etc.), in other examples, the scaling value may be any number. In some implementations, the scaling circuitry 124 may be configured to scale the synthesized high band audio signal ($\tilde{S}_{HB}$) 150 to generate a scaled synthesized high band audio signal.

The parameter determination circuitry 126 may be configured to receive the high band audio signal ($S_{HB}$) 140, the synthesized high band audio signal ($\tilde{S}_{HB}$) 150, and the scaled high band audio signal 160. In some implementations, the parameter determination circuitry 126 may not receive one or more of the high band audio signal ($S_{HB}$) 140, the synthesized high band audio signal ($\tilde{S}_{HB}$) 150, and the scaled high band audio signal 160.

The parameter determination circuitry 126 may be configured to generate the one or more gain parameters 170 based on one or more of the high band audio signal ($S_{HB}$) 140, the synthesized high band audio signal ($\tilde{S}_{HB}$) 150, and the scaled high band audio signal 160. The one or more gain parameters 170 may be determined based on a ratio, such as an energy ratio (e.g., a power ratio), that is associated with the high band audio signal ($S_{HB}$) 140 and the synthesized high band audio signal ($\tilde{S}_{HB}$) 150. For example, the parameter determination circuitry 126 may determine gain shapes for each of the sub-frames of a frame and may determine a gain frame for the frame as a whole, as further described herein.

In some implementations, the parameter determination circuitry 126 may be configured to provide one or more values, such as the one or more gain parameters 170 or an intermediate value associated with determining the one or more gain parameters 170, to the scaling circuitry 124. The scaling circuitry 124 may use the one or more values to scale the high band audio signal ($S_{HB}$) 140. Additionally or alternatively, the scaling circuitry 124 may use the one or more values to scale the synthesized high band audio signal ($\tilde{S}_{HB}$) 150, as described with reference to FIG. 2.

During operation, the encoder 104 may receive the input audio signal 110 and the filter bank 120 may generate the high band audio signal ($S_{HB}$) 140. The high band audio signal ($S_{HB}$) 140 may be provided to the synthesizer 122 and to the gain parameter circuitry 102. The synthesizer 122 may generate the synthesized high band audio signal ($\tilde{S}_{HB}$) 150 based on the high band audio signal ($S_{HB}$) 140 and may provide the synthesized high band audio signal ($\tilde{S}_{HB}$) 150 to the gain parameter circuitry 102. The gain parameter circuitry 102 may generate the one or more gain parameters 170 based the high band audio signal ($S_{HB}$) 140, the synthesized high band audio signal ($\tilde{S}_{HB}$) 150, the scaled high band audio signal 160, or a combination thereof.

In a particular aspect, to determine gain shapes for a frame of the high band audio signal ($S_{HB}$) 140, the parameter determination circuitry 126 may be configured to determine, for each sub-frame of the frame, whether a first energy value of the sub-frame is saturated. To illustrate, in fixed-point programming, a 32-bit variable can hold a maximum positive value of $2^{31}-1=2147483647$. If a particular energy value is greater than or equal to $2^{31}-1$, the particular energy value, and therefore the corresponding sub-frame or frame, is considered saturated.

If a sub-frame is determined to be unsaturated, the parameter determination circuitry 126 may determine a corresponding sub-frame gain shape parameter for the particular sub-frame that is based on a ratio associated with the high band audio signal ($S_{HB}$) 140 and the synthesized high band audio signal ($\tilde{S}_{HB}$) 150. If a sub-frame is determined to be saturated, the parameter determination circuitry 126 may determine a corresponding sub-frame gain shape parameter for the particular sub-frame that is based on a ratio of the scaled high band audio signal 160 and the synthesized high band audio signal ($\tilde{S}_{HB}$) 150. The scaled high band audio signal 160 used to determine a particular sub-frame gain shape parameter may be generated by scaling the high band audio signal ($S_{HB}$) 140 using a predetermined scaling factor, such as a scaling factor of two (which may effectively halve high band signal amplitudes), as an illustrative, non-limiting example. The parameter determination circuitry 126 may thus output a gain shape for each sub-frame of the frame. In some implementations, the parameter determination circuitry 126 may count how many sub-frames of the frame were determined to be saturated and may provide a signal (e.g., data) to the scaling circuitry 124 indicating the number of sub-frames. Calculation of gain shapes is further described with reference to FIGS. 2-4.

The parameter determination circuitry 126 may also be configured to determine a gain frame parameter for the frame of the high band audio signal ($S_{HB}$) 140 using the scaled high band audio signal 160. For example, the parameter determination circuitry 126 may calculate the gain frame parameter for the frame based on a ratio associated with the scaled high band audio signal 160 and the synthesized high band audio signal ($\tilde{S}_{HB}$) 150. In some implementations, the gain frame parameter for the frame may be determined based on a ratio of the scaled high band audio signal 160 and a scaled version of the synthesized high band audio signal ($\tilde{S}_{HB}$) 150. For example, the scaling circuitry 124 may use gain shape parameter(s) (or a quantized version of the gain shape parameter(s)) to generate the scaled version of the synthesized high band audio signal ($\tilde{S}_{HB}$)$^{150}$.

The gain frame parameter may be generated using one or more techniques. In a first technique, the scaled high band audio signal 160 used to determine the gain frame parameter may be generated by the scaling circuitry 124 based on the number of saturated sub-frames of the frame that were identified during gain shape estimation. For example, the scaling circuitry 124 may determine a scaling factor that is based on the number of saturated sub-frames. To illustrate, the scaling factor may be determined as, scaling factor (SF)=$2^{1+N/2}$, where N is the number of saturated sub-frames. In some implementations, a ceiling function or a floor function may be applied to the value of (N/2). The scaling circuitry 124 may apply the scaling factor (SF) to the high band audio signal ($S_{HB}$) 140 to generate the scaled high band audio signal 160.

In a second technique, the scaled high band audio signal 160 used to determine the gain frame parameter may be generated by the scaling circuitry 124 based on a predetermined scaling factor. For example, the predetermined scaling factor may be a scaling factor of 2, 4 or 8, as illustrative, non-limiting examples. The scaling factor may be stored in a memory coupled to the scaling circuitry 124, such as a memory (not shown) that is coupled to the encoder 104. In some implementations, the scaling factor may be provided the memory to a register that is accessible to the scaling circuitry 124. The scaling circuitry 124 may apply the predetermined scaling factor to the high band audio signal ($S_{HB}$) 140 to generate the scaled high band audio signal 160.

In a third technique, the scaling circuitry 124 may use an iterative process to generate the scaled high band audio signal 160 used to determine the gain frame parameter. For example, the parameter determination circuitry 126 may determine whether energy of the frame of the high band audio signal ($S_{HB}$) 140 is saturated. If the energy of the frame is unsaturated, the parameter determination circuitry 126 may determine the gain frame parameter based on a ratio of the energy value of the frame of the high band audio signal ($S_{HB}$) 140 and the synthesized high band audio signal ($\tilde{S}_{HB}$) 150 (or a scaled version of the synthesized high band audio signal ($\tilde{S}_{HB}$) 150). Alternatively, if the energy of the frame is saturated, the scaling circuitry 124 may apply a first scaling factor (e.g., a scaling factor of 2, 4, or 8, as illustrative, non-limiting examples) to generate a first scaled high band audio signal.

In a fourth technique, the scaling circuitry 124 may use a process to generate the scaled high band audio signal 160 that is used to determine the gain frame parameter. To illustrate, the parameter determination circuitry 126 may determine whether energy of the frame of the high band audio signal ($S_{HB}$) 140 is saturated. If the energy of the frame is unsaturated, the parameter determination circuitry 126 may determine the gain frame parameter based on a ratio of an energy value of the frame of the high band audio signal ($S_{HB}$) 140 and an energy value of synthesized high band audio signal ($\tilde{S}_{HB}$) 150 (or a scaled version of the synthesized high band audio signal ($\tilde{S}_{HB}$) 150). Alternatively, if the energy of the frame is saturated, the scaling circuitry 124 may determine a first scale factor based on the number of saturated sub-frames (of the frame). To illustrate, the first scaling factor may be determined as, scaling factor (SF)=$2^{1+N/2}$, where N is the number of saturated sub-frames. It should be noted that alternate implementations to generate the scaling factor based on the number of saturated sub-frames may be used. The scaling circuitry 124 may apply the first scaling factor to generate a first scaled high band audio signal, such as the scaled high band audio signal 160. The parameter determination circuitry 126 may determine the gain frame parameter based on a ratio of an energy value of the first scaled high band audio signal ($S_{HB}$) 160 and the energy of the synthesized high band audio signal ($\tilde{S}_{HB}$) 150 (or of a scaled version of the synthesized high band audio signal ($\tilde{S}_{HB}$) 150).

In another technique, the parameter determination circuitry 126 may optionally determine whether an energy corresponding to the first scaled high band audio signal is saturated. If the energy of the first scaled high band audio signal is unsaturated, the parameter determination circuitry 126 may determine the gain frame parameter using the first scaled high band audio signal. Alternatively, if the energy of the frame is saturated, the scaling circuitry 124 may apply a second scaling factor (e.g., a scaling factor of 4 or 8, as illustrative, non-limiting examples) to generate a first scaled high band audio signal. The second scaling factor may be greater than the first scaling factor. The scaling circuitry 124 may continue to generate scaled high band audio signals using greater scaling factors until the parameter determination circuitry 126 identifies a particular scaled high band audio signal that is not saturated. In other implementations, the scaling circuitry 124 may perform a predetermined number of iterations and if the parameter determination circuitry 126 does not identify an unsaturated scaled high band audio signal, the parameter determination circuitry 126 may use the high band audio signal ($S_{HB}$) 140 or a particular scaled high band audio signal (generated by the scaling circuitry 124) to determine the gain frame parameter.

In some implementations a combination of multiple techniques may be used to generate the gain frame parameter. For example, the scaling circuitry 124 may use the number of saturated sub-frames to generate the first scaled high band audio signal (e.g., the scaled high band audio signal 160). The parameter determination circuitry 126 may determine whether energy of the scaled high band audio signal 160 is saturated. If the energy value is unsaturated, the parameter determination circuitry 126 may use the first scaled high band audio signal (e.g., the scaled high band audio signal 160) to determine the gain frame parameter. Alternatively, if the energy value is saturated, the scaling circuitry 124 may generate a second scaled high band audio signal using a particular scaling factor that is greater than the scaling factor used to generate the first scaled high band audio signal (e.g., the scaled high band audio signal 160).

The system 100 (e.g., the encoder 104) of FIG. 1 may generate a scaled version of the high band audio signal ($S_{HB}$) 140 to be used to determine the one or more gain parameters 170. Scaling the high band audio signal ($S_{HB}$) 140 may avoid saturation of the high band audio signal ($S_{HB}$) 140 (e.g., an energy value of high band audio signal ($S_{HB}$) 140). Using an unsaturated energy value to determine the one or more gain parameters 170 may mitigate inaccuracies in the calculation of the gains (e.g., gain shape) to be applied on the synthesized high band signal ($\tilde{S}_{HB}$) 150 which, in effect, mitigates degradation in audio quality (associated with the high band).

Figure 2:
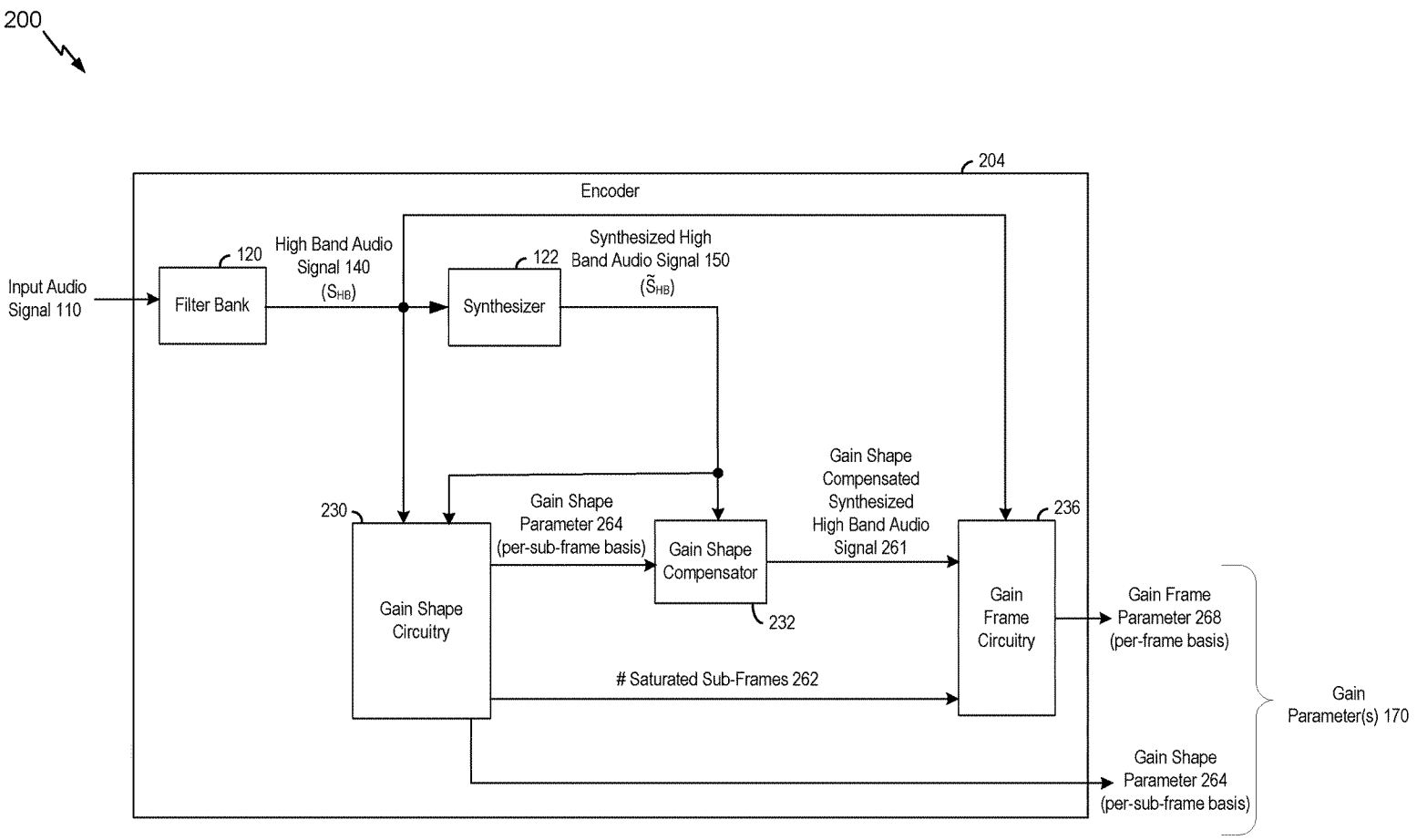
FIG. 2 is a block diagram of another example of a system that is configured to determine one or more gain parameters.

Referring to FIG. 2, a particular illustrative aspect of a system operable to generate one or more gain parameters is disclosed and generally designated 200. The system 200 may correspond to (e.g., include components described with reference to) the system 100 of FIG. 1.

The system 200 may include the encoder 204. The encoder 204 may include or correspond to the encoder 104 of FIG. 1. The encoder 204 may be configured to receive the input audio signal 110 and to generate the one or more gain parameters 170, such as a gain shape parameter 264, a gain frame parameter 268, or a combination thereof. The encoder 204 may include the filter bank 120, the synthesizer 122, gain shape circuitry 230, a gain shape compensator 232, and gain frame circuitry 236. The gain shape circuitry 230, the gain shape compensator 232, the gain frame circuitry 236, or a combination thereof, may correspond to the gain parameter circuitry 102 or components thereof. For example, the gain shape circuitry 230, the gain shape compensator 232, the gain frame circuitry 236, or a combination thereof, may perform one or more operations, one or more functions as described with reference to the scaling circuitry 124 of FIG. 1, one or more functions as described with reference to the parameter determination circuitry 126 of FIG. 1, or a combination thereof.

The gain shape circuitry 230 (e.g., gain shape logic or a gain shape module) is configured to determine the gain shape parameter 264, such as an estimated gain shape value, based on a first ratio that is associated with the high band audio signal ($S_{HB}$) 140 and the synthesized high band audio signal ($\tilde{S}_{HB}$) 150. The gain shape parameter 264 may be determined on a per-sub-frame basis. For example, the gain shape parameter 264 of a particular frame may include an array (e.g., a vector or other data structure) that includes a value (e.g., a gain shape value) for each sub-frame of the particular frame. It is noted that the gain shape parameter 264 may be quantized by the gain shape circuitry 230 prior to being output by the gain shape circuitry 230.

To illustrate, for a particular sub-frame, the gain shape circuitry 230 may determine whether the particular sub-frame (e.g., an energy of the particular sub-frame) is saturated. If the particular sub-frame is not saturated, gain shape value of the particular sub-frame may be determined using the high band audio signal ($S_{HB}$) 140 and the synthesized high band audio signal ($\tilde{S}_{HB}$) 150. Alternatively, if the particular sub-frame is saturated, the gain shape circuitry may scale the high band audio signal ($S_{HB}$) 140 to generate a scaled high band audio signal and the gain shape value of the particular sub-frame may be determined using the scaled high band audio signal and synthesized high band audio signal ($\tilde{S}_{HB}$) 150. For a particular frame, the gain shape circuitry 230 may be configured to determine (e.g., count) a number of saturated sub-frames 262 (of multiple sub-frames) of the particular frame and output a signal (e.g., or data) that indicates the number of saturated sub-frames 262.

The gain shape circuitry 230 may further be configured to provide the gain shape parameter 264 (e.g., an estimated gain shape parameter) to the gain shape compensator 232, as shown. The gain shape compensator 232 (e.g., gain shape compensation circuitry) may be configured to receive the synthesized high band audio signal ($\tilde{S}_{HB}$) 150 and the gain shape parameter 264. The gain shape compensator 232 may scale the synthesized high band audio signal ($\tilde{S}_{HB}$) 150 (on a per-sub-frame basis) to generate a gain shape compensated synthesized high band audio signal 261. Generation of the gain shape compensated synthesized high band audio signal 261 may be referred to as gain shape compensation.

The gain frame circuitry 236 (e.g., gain frame logic or a gain frame module) is configured to determine the gain frame parameter 268, such as an estimated gain frame value, based on a second ratio that is associated with the high band audio signal ($\tilde{S}_{HB}$) 140 and the synthesized high band audio signal ($\tilde{S}_{HB}$) 150. The gain frame circuitry 236 may determine the gain frame parameter on a per-frame basis. For example, the gain frame circuitry 236 may determine the gain frame parameter 268 based on a second ratio that is associated with the high band audio signal ($S_{HB}$) 140 and the synthesized high band audio signal ($\tilde{S}_{HB}$) 150.

To illustrate, to calculate the gain frame parameter 268 for a particular frame, the gain frame circuitry 236 may scale the high band audio signal ($S_{HB}$) 140 based on the number of saturated sub-frames 262 determined by the gain shape circuitry 230. For example, the gain frame circuitry 236 may determine (e.g., look-up from a table or calculate) a scaling factor based on the number of saturated sub-frames 262. It should be noted that in alternate implementations, this scaling need not be performed within the gain frame circuitry 236, and may be performed at another component of the encoder 204 that is upstream from the gain frame circuitry 236 (e.g., prior to the gain frame circuitry 236 in a signal processing chain). The gain frame circuitry 236 may apply the scaling factor to the high band audio signal ($S_{HB}$) 140 to generate a second scaled high band audio signal. The gain frame circuitry 236 may determine the gain frame parameter 268 based on the second scaled high band audio signal and the gain shape compensated synthesized high band audio signal 261. For example, the gain frame parameter 268 may be determined based on a ratio of an energy value of the second scaled high band audio signal and an energy value of the gain shape compensated synthesized high band audio signal 261. In some implementations, the gain frame parameter 268 may be quantized by the gain frame circuitry 236 prior to being output by the gain frame circuitry 236.

To illustrate another alternative implementation to calculate the gain frame parameter 268 for a particular frame, the gain frame circuitry 236 may estimate a first energy value associated with the high band audio signal ($S_{HB}$) 140. If the first energy value is not saturated, the gain frame circuitry 236 may estimate the gain frame based on the ratio of the first energy parameter and a second energy parameter. The second energy parameter may be based on the energy estimated of the gain shape compensated synthesized high band audio signal 261. If the first energy value is found to be saturated, the gain frame circuitry 236 may then estimate a scaling factor which is determined (e.g., identified using a look-up from a table or calculated) based on the number of saturated sub-frames 262 determined by the gain shape circuitry 230. The gain frame circuitry 236 may apply the scaling factor to the high band audio signal ($S_{HB}$) 140 to generate a first scaled high band audio signal. The gain frame circuitry 236 may re-estimate a third energy value associated with the first scaled high band audio signal. The gain frame circuitry 236 may determine the gain frame parameter 268 based on the first scaled high band audio signal and the gain shape compensated synthesized high band audio signal 261. For example, the gain frame parameter 268 may be determined based on a ratio of the third energy value corresponding to the first scaled high band audio signal and the second energy value corresponding to the gain shape compensated synthesized high band audio signal 261.

During operation, for a particular frame of the input audio signal 110, the gain shape circuitry 230 may scale the high band audio signal ($S_{HB}$) 140 to generate a first scaled high band audio signal. The gain shape circuitry 230 may determine the gain shape parameter 264 for each sub-frame of the frame using the first scaled high band audio signal. Additionally, the gain shape circuitry 230 may determine the number of saturated sub-frames 262 of the frame. The gain frame circuitry 236 may scale the high band audio signal ($S_{HB}$) 140 based on the number of saturated sub-frames 262 to generate a second scaled high band audio signal, and may determine the gain frame parameter 268 based on the second scaled high band audio signal.

The encoder 204 (e.g., the gain shape circuitry 230, the gain frame circuitry 236, or a combination thereof) may be configured to reduce saturation of one or more energy values used to generate the one or more gain parameters 170. For example, for a frame (m), where m may be a non-negative integer and may represent a frame number, that includes multiple sub-frames (i), where i is a non-negative integer, saturation may occur during a first energy calculation of the high band audio signal ($S_{HB}$) 140 to calculate a sub-frame energy ($E_{S_{HB}}(i)$) that may be used to determine the gain shape parameter 264 (e.g., a value of the gain shape parameter 264). Additionally or alternatively, saturation may occur during a second energy calculation of the high band audio signal ($S_{HB}$) 140 to calculate a frame energy ($E_{S_{HB}}^{fr}$) that may be used to determine the gain frame parameter 268 (e.g., a value of the gain frame parameter 268). As used herein, the superscript "fr" denotes that a parameter, such as the frame energy, corresponds to an entire frame and is not specific to any particular sub-frame (i).

In some implementations, the gain shape circuitry 230 may be configured to estimate a gain shape value for each sub-frame of a frame. For example, a particular frame (m) may have a value of m=1 and (i) includes a set of values i=[1, 2, 3, 4], as an illustrative, non-limiting example. In other examples, the particular frame (m) may have another value and (i) may include a different set of values. The gain shape parameter 264 (e.g., GainShape[i]) may be determined as power ratio for each sub-frame (i) of the high band audio signal ($S_{HB}$) 140 the synthesized high band audio signal ($\tilde{S}_{HB}$) 150.

In the following examples, a first frame (m) includes 320 audio samples, which can be divided into four sub-frames of 80 audio samples each. To calculate the gain shape value for each sub-frame (i) of the first frame (m), the gain shape circuitry 230 may calculate the sub-frame energy value $E_{S_{HB}}(i)$ for that sub-frame of the high band audio signal ($S_{HB}$) 140. The sub-frame energy value $E_{S_{HB}}(i)$ may be calculated as:

$$E_{S_{HB}}(i)=\Sigma_{k=i*80-20}^{i*80+79} S_{HB}(k)^2 * w(k),$$

Where w is an overlapping window. For example, may the overlapping window may have a length of 100 samples that includes 80 samples from a first sub-frame (i) and 20 samples (corresponding to a smoothing overlap) from a previous sub-frame (i−1). If i−1 is zero, the previous sub-frame (i−1) may be a last sub-frame of a previous frame (m−1) that sequentially precedes the first frame (m). An example of the overlapping window is described with reference to FIG. 4. The sizes of the window and the overlap are for illustrative purposes and should not be considered limiting.

To calculate the gain shape value for each sub-frame (i), the gain shape circuitry 230 may calculate the sub-frame energy value $E_{\tilde{S}_{HB}}(i)$ for that corresponding sub-frame of the synthesized high band audio signal ($\tilde{S}_{HB}$) 150 (or a scaled version of the synthesized high band audio signal $\tilde{S}_{HB}$ 150). The sub-frame energy value $E_{\tilde{S}_{HB}}(i)$ may be calculated as:

$$E_{\tilde{S}_{HB}}(i)=\Sigma_{k=i*80-20}^{i*80+79} \tilde{S}_{HB}(k)^2 * w(k),$$

If saturation is not detected, the sub-frame energy value $E_{S_{HB}}(i)$ may be used to determine the gain shape value for sub-frame (i) (e.g., GainShape[i]), which may be calculated as:

$$GainShape(i) = \sqrt{\frac{E_{S_{HB}}(i)}{E_{\tilde{S}_{HB}}(i)}},$$

where sub-frame energy value $E_{S_{HB}}(i)$ is the energy of the high band audio signal ($S_{HB}$) 140 and $E_{\tilde{S}_{HB}}$ is the sub-frame energy value of the synthesized high band audio signal ($\tilde{S}_{HB}$) 150 (or a scaled version of the synthesized high band audio signal ($\tilde{S}_{HB}$) 150). The gain shape value for sub-frame (i) may be included in the gain shape parameter 264.

Alternatively, if the sub-frame energy value $E_{S_{HB}}(i)$ is detected to be saturated, the gain shape circuitry 230 may scale the high band audio signal ($S_{HB}$) 140 by a factor of 2, as illustrative, non-limiting example, to calculate the sub-frame energy $E_{S_{HB}}(i)$:

$$E_{S_{HB}}(i) = \sum_{k=i*80-20}^{i*80+79} \left\{\frac{s_{HB}(k)}{2}\right\}^2 * w(k).$$

This $E_{S_{HB}}(i)$ calculated using the scaled high band audio signal ($S_{HB}$) is one-fourth of the original $E_{S_{HB}}(i)$, which had saturation. Scaling down by the factor of 2 may result in a divide by four operation because the scaling factor is squared, which may reduce a likelihood of saturation. Although a scaling down by a factor of 2 is described to avoid saturation, other factors may be used. The scaling down of energy by 4 can be accounted for in the GainShape calculation by scaling the final GainShape(i) up by a factor of 2:

$$GainShape(i) = 2 * \sqrt{\frac{E_{S_{HB}}(i)}{E_{\tilde{s}_{HB}}(i)}}.$$

Accordingly, by applying a scaling factor to the high band audio signal ($S_{HB}$) 140, saturation of the sub-frame energy value $E_{S_{HB}}(i)$ may be avoided.

In some implementations, the gain shape circuitry 230 may scale the synthesized high band audio signal ($\tilde{S}_{HB}$) 150 to generate a scaled synthesized signal. For example, the gain shape circuitry 230 may apply a synthesis scaling factor to the synthesized high band audio signal ($\tilde{S}_{HB}$) 150 to generate the scaled synthesized signal. The gain shape circuitry 230 may use the scaled synthesized signal to calculate the gain shape parameter 264 (e.g., GainShape). For example, to calculate the gain shape parameter 264 (e.g., GainShape), the gain shape circuitry 230 may account for the synthesis scaling factor. To illustrate, if the synthesis scaling factor is 2 and no scaling factor is applied to the high band audio signal ($S_{HB}$) 140, the gain shape parameter 264 may be computed as:

$$GainShape(i) = \frac{1}{2} * \sqrt{\frac{E_{S_{HB}}(i)}{E_{\hat{S}_{HB}}(i)}}.$$

As another example, if the synthesis scaling factor is 2 and the scaling factor is applied to the high band audio signal ($S_{HB}$) 140 is 2, the gain shape parameter 264 may be computed as:

$$GainShape(i) = \frac{2}{2} * \sqrt{\frac{E_{S_{HB}}(i)}{E_{\hat{S}_{HB}}(i)}}.$$

Once the GainShapes are estimated for the frame, the GainShapes may be quantized to obtain GainShapes'[i]. The synthesized high band audio signal ($\hat{S}_{HB}$) 150 may be scaled by the gain shape compensator 232 on a sub-frame basis with the quantized GainShapes' [i] to generate the gain shape compensated synthesized high band audio signal 261. Generating the gain shape compensated synthesized high band audio signal 261 may be referred to GainShape Compensation.

After the GainShape compensation is completed, the gain frame circuitry 236 may estimate the gain frame parameter 268. To determine the gain frame parameter 268 (e.g., GainFrame), the gain frame circuitry 236 may calculate a frame energy value $E_{S_{HB}}^{fr}$ of a frame using an overlapping window $w^{fr}$. In some implementations, the frame energy value $E_{S_{HB}}^{fr}$ may be calculated as:

$$E_{S_{HB}}^{fr}=\Sigma_{k=-20}^{319} S_{HB}(k)^2 * w^{fr}(k).$$

The overlapping window may include 340 samples, such as 320 samples of a first frame (m) and 20 samples (corresponding to an overlap) from a previous frame (m−1) that sequentially precedes the first frame (m). An example of the overlapping window $w^{fr}$ used to determine the gain frame parameter 268 is described with reference to FIG. 4. The sizes of the window and the overlap are for illustrative purposes and should not be considered limiting. In some implementations, the window may not overlap at all.

Since the frame energy value $E_{S_{HB}}^{fr}$ calculation is done on 340 samples (unlike 100 samples for $E_{S_{HB}}(i)$ used to calculate GainShape(i)), more sample energy values are being accumulated and $E_{S_{HB}}^{fr}$ is likely to saturate.

The gain frame circuitry 236 may determine if saturation of the frame energy value $E_{S_{HB}}^{fr}$ occurred. If no saturation occurred, the gain frame parameter 268 may be calculated as:

$$GainFrame = \sqrt{\frac{E_{S_{HB}}^{fr}}{E_{\hat{S}_{HB}}^{fr}}}.$$

If saturation of the frame energy value $E_{S_{HB}}^{fr}$ is detected by the gain frame circuitry 236, a scaling factor may be applied to the high band audio signal ($S_{HB}$) 140 to avoid saturation. The scaling factor could range anywhere from 2 to 8, as illustrative, non-limiting examples, when saturation is detected. To illustrate, if the frame energy value $E_{S_{HB}}^{fr}$'s true value without any saturation enforced is $2^{34}$, scaling the high band audio signal ($S_{HB}$) 140 by a factor of 2 would produce a calculated frame energy value $E_{S_{HB}}^{fr}$ that is reduced by 4 times (e.g., $4=2^{32}(>2^{(31-1)})$) and saturation would still be detected. However, if the high band audio signal ($S_{HB}$) 140 is scaled by a factor of 4, the frame energy value $E_{S_{HB}}^{fr}$ is effectively reduced 16 times which would be $(2^{34}/16=2^{30}(<=2^{(31-1)}))$, effectively avoiding any saturation.

In some implementations, because of the high likelihood of the frame energy value $E_{S_{HB}}^{fr}$ being saturated if scaling is not applied, scaling may automatically be applied to the high band audio signal ($S_{HB}$) 140 to calculate the frame energy value $E_{S_{HB}}^{fr}$. In other implementations, scaling may be applied after a determination a frame energy value $E_{S_{HB}}^{fr}$ calculated without scaling is saturated.

In a first technique, a scaling factor may be estimated based on a number of sub-frames (i) of a frame detected to be saturated during calculation of the sub-frame energies $E_{S_{HB}}^{fr}(i)$ included the gain shape parameter 264 (e.g., the GainShape). For example, if $E_{S_{HB}}(0)=2^{32}$, $E_{S_{HB}}(1)=2^{30}$, $E_{S_{HB}}(2)=2^{32}$, $E_{S_{HB}}(3)=2^{30}$, there are two sub-frames are greater than $2^{31}-1$ meaning two sub-frames are found to be saturating by the gain shape circuitry 230. It may be likely (e.g., highly likely) that the frame energy value $E_{S_{HB}}^{fr}$ will be saturated and that:

$$E_{S_{HB}}^{fr}<=E_{S_{HB}}(0)=E_{S_{HB}}(1)=E_{S_{HB}}(2)=E_{S_{HB}}(3) \quad (3)$$

It can also be likely (e.g., highly likely) that despite the frame energy value $E_{S_{HB}}^{fr}$ being less than or equal to $E_{S_{HB}}(0)+E_{S_{HB}}(1)+E_{S_{HB}}(2)+E_{S_{HB}}(3)$, the frame energy value $E_{S_{HB}}^{fr}$ would be substantially close to $E_{S_{HB}}(0)+E_{S_{HB}}(1)+E_{S_{HB}}(2)=E_{S_{HB}}(3)$.

In this example, $E_{S_{HB}}^{fr}<=2^{32}+2^{30}+2^{32}+2^{30}=1.25*2^{33}$. Since $E_{S_{HB}}^{fr}<=1.25*2^{33}$, the frame energy value $E_{S_{HB}}^{fr}$ may be approximated to be of the order of $2^{33}$. Thus, if the high band audio signal ($S_{HB}$) 140 is scaled by 2, the frame energy $E_{S_{HB}}^{fr}$ may be reduced by 4 times. The gain frame circuitry 236 may recalculate the frame energy value $E_{S_{HB}}^{fr}$ using the scaling factor and the recalculated $E_{S_{HB}}^{fr}$ may be of the order of $2^{31}$, and saturation may be avoided.

To generalize this example, the gain frame circuitry 236 may determine a scale factor to be applied on the high band audio signal ($S_{HB}$) 140 to avoid saturation in the frame energy value $E_{S_{HB}}^{fr}$ calculation. For example, the scale factor may be based on the number of sub-frame energies $E_{S_{HB}}(i)$ which saturate (e.g., the number of saturated sub-frames 262). To illustrate, the scale factor for the high band audio signal ($S_{HB}$) 140 may be determined as:

$$\text{Factor}=2^{1++N2},$$

where N is the number of saturating sub-frames (e.g., where N is number of saturated sub-frames 262). In some implementations, the value of N/2 may be calculated using a ceiling function or a flooring function. Using the scaling factor, the frame energy value $E_{S_{HB}}^{fr}$ may be calculated as:

$$E_{S_{HB}}^{fr} = \sum_{k=-20}^{319} \left\{\frac{s_{HB}(k)}{\text{Factor}}\right\}^2 * w^{fr}(k),$$

and the gain frame parameter 268 may be calculated as:

$$GainFrame = \text{Factor} * \sqrt{\frac{E_{S_{HB}}^{fr}}{E_{\hat{S}_{HB}}^{fr}}}.$$

If the gain frame parameter 268 (e.g., GainFrame) were calculated using a saturated frame energy value $E_{S_{HB}}^{fr}$ and no factor was applied (e.g., a factor=1), an estimated value of the gain frame parameter 268 be lower than the true value of the gain frame and attenuation of the high band audio signal may occur.

In a second technique, the scaling factor applied by the gain frame circuitry 236 to the high band audio signal ($S_{HB}$) 140 may be a predetermined scaling factor. For example, the predetermined scaling factor may be a scaling factor of 2, 4, or 8, as illustrative, non-limiting examples.

Additionally or alternatively, the gain frame circuitry 236 may use a third technique by which the gain frame circuitry 236 may iteratively increase the scaling factor applied to the high band audio signal ($S_{HB}$) 140. For example, if saturation of the frame energy value $E_{S_{HB}}^{fr}$ is detected by the gain frame circuitry 236 without using scaling, scaling may be iteratively performed by the gain frame circuitry 236. For example, in the first iteration, the gain frame circuitry 236 may scale the high band audio signal ($S_{HB}$) 140 by a factor of 2 and re-calculate frame energy value $E_{S_{HB}}^{fr}$. If re-calculated frame energy value $E_{S_{HB}}^{fr}$ is saturated, the gain frame circuitry 236 may, in the second iteration, scale the high band audio signal ($S_{HB}$) 140 by a factor of 4 and re-calculate frame energy value $E_{S_{HB}}^{fr}$. The gain frame circuitry 236 may continue to perform iterations until an unsaturated is frame energy value $E_{S_{HB}}^{fr}$ detected. In other implementations, the gain frame circuitry 236 may perform up to a threshold number of iterations.

In this proposed solution, when the frame energy value $E_{S_{HB}}^{fr}$ is found to be saturating, the re-calculation of frame energy value $E_{S_{HB}}^{fr}$ is only done once, with a scale down factor calculated using the above mentioned equation, thus saving on complexity.

In some implementations, the second technique, the third technique, or a combination thereof, may be combined with the first technique. For example, the second technique may be applied by the gain frame circuitry 236 and, if the calculated frame energy value $E_{S_{HB}}^{fr}$ is saturated, the second or third technique may be implemented, where a first scaling factor used during the second or third technique is greater than a scaling factor used during the first technique.

The system 200 (e.g., the encoder 204) of FIG. 2 may generate a scaled version of the high band audio signal ($S_{HB}$) 140 to be used to determine the one or more gain parameters 170. Scaling the high band audio signal ($S_{HB}$) 140 may avoid saturation of the high band audio signal ($S_{HB}$) 140 (e.g., an energy value of high band audio signal ($S_{HB}$) 140). Using an unsaturated energy value may enable determining values or the one or more gain parameters 170 that are not affected by saturation and, thus, an audio quality (associated with the high band audio signal ($S_{HB}$) 140) may not be degraded by attenuation of the high band audio signal ($S_{HB}$) 140.

Figure 3:
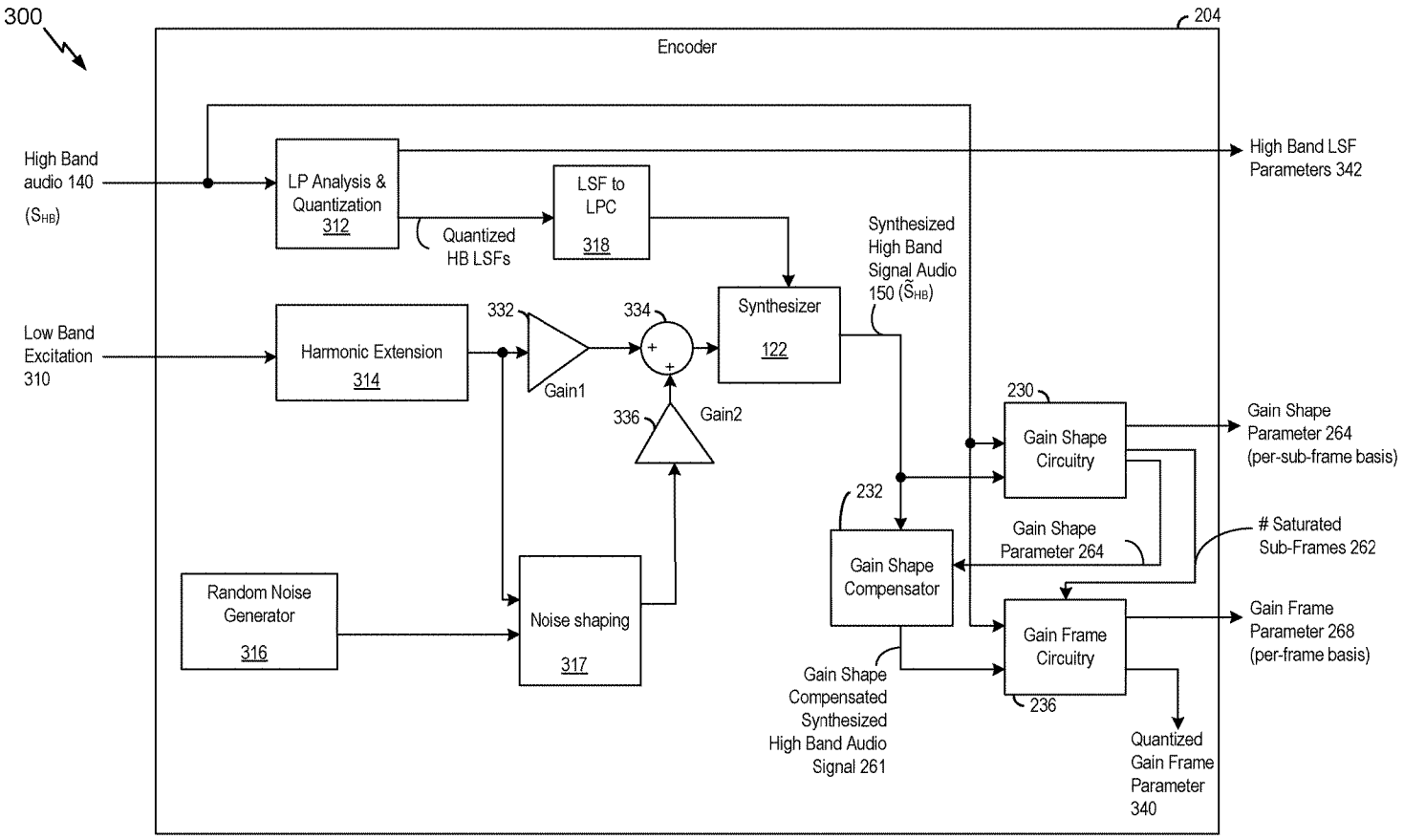
FIG. 3 is a block diagram of another example of a system that is configured to determine one or more gain parameters.

Referring to FIG. 3, a particular illustrative aspect of a system operable to generate one or more gain parameters is disclosed and generally designated 300. The system 300 may correspond to (e.g., include components described with reference to) the system 100 of FIG. 1 or the system 200 of FIG. 2.

The encoder 204 may include a linear prediction (LP) analysis and quantization circuitry 312, a line spectral frequency (LSF) to linear prediction coefficient (LPC) circuitry 318, harmonic extension circuitry 314, a random noise generator 316, noise shaping circuitry 317, a first amplifier 332, a second amplifier 336, and a combiner 334. The encoder 204 further includes the synthesizer 122, the gain shape compensator 232, the gain shape circuitry 230, and the gain frame circuitry 236. The encoder 204 may be configured to receive the high band audio signal ($S_{HB}$) 140 and low band excitation signal 310. The encoder 204 may be configured to output high band LSF parameter(s) 342, the gain shape parameter 264, and the gain frame parameter 268. A quantized gain frame parameter 340 may be output by the gain frame circuitry 236 and may be discarded by the encoder 204.

The LP analysis and quantization circuitry 312 may be configured to determine a line spectral frequency (e.g., high band LSF parameter(s) 342) of the high band audio signal ($S_{HB}$) 140. In some implementations the high band LSF parameter(s) 342 may be output by the LP analysis and quantization circuitry 312 as quantized high band LSF parameter(s). The LP analysis and quantization circuitry 312 may quantize the high band LSF parameter(s) 342 to generate quantized high band LSFs. The LSF to LPC circuitry 318 may convert the quantized high band LSFs to one or more LPCs that are provided to the synthesizer 122.

The low band excitation signal 310 may be generated by a speech encoder, such as an algebraic code-excited linear prediction (ACELP) encoder. The low band excitation signal 310 may be received by the harmonic extension circuitry 314. The harmonic extension circuitry 314 may be configured to generate a high band excitation signal by extending a spectrum of the low band excitation signal 310. An output of the harmonic extension circuitry 314 may be provided to a combiner 334 via a first amplifier 332 (e.g., a scaling circuitry) having a first gain value (Gain1). The output of the harmonic extension circuitry 314 may also be provided to a noise shaping circuitry 317.

The random noise generator 316 may be configured to provide a random noise signal to the noise shaping circuitry 317. The noise shaping circuitry 317 may process the output of the harmonic extension circuitry 314 and the random noise signal to provide an output signal to the combiner 334 via a second amplifier 336 (e.g., a scaling module) having a second gain value (Gain2).

The combiner 334 may be configured to generate a high band excitation signal that is provided to the synthesizer 122. The synthesizer 122 may generate the synthesized high band audio signal ($\tilde{S}_{HB}$) 150. For example, the synthesizer 122 may be configured according to the LPCs received from the LSF to LPC circuitry 318. The configured synthesizer 122 may output the synthesized high band audio signal ($\tilde{S}_{HB}$) 150 based on the high band excitation signal received from the combiner 334. The 150 may be processed by the gain shape circuitry 230, the gain frame circuitry 236, the gain shape compensator 232, or a combination thereof, to accommodate energy value saturation and to generate the gain shape parameter 264, the gain frame parameter 268, or a combination thereof, as described with reference to FIG. 2.

Although the synthesizer 122 is described as being distinct from the LP analysis and quantization circuitry 312, the LSF to LPC circuitry 318, the harmonic extension circuitry 314, the random noise generator 316, the noise shaping circuitry 317, the first amplifier 332, the second amplifier 336, and the combiner 334, in other implementations, the synthesizer 122 may include one or more of the LP analysis and quantization circuitry 312, the LSF to LPC circuitry 318, the harmonic extension circuitry 314, the random noise generator 316, the noise shaping circuitry 317, the first amplifier 332, the second amplifier 336, and the combiner 334.

FIG. 4 depicts graphs that illustrate determining energy values associated with an audio signal. The audio signal may correspond to the high band audio signal ($S_{HB}$) 140 of FIG. 1. The energy values may be determined by the gain parameter circuitry 102 (e.g., the parameter determination circuitry 126) of FIG. 1, the gain shape circuitry 230 or the gain frame circuitry 236 of FIG. 2.

A first graph 400 illustrates overlapping windows (w) used to determine sub-frame energy values $E_{S_{HB}}(i)$ of a first frame (m) that are check for saturation and that may be scaled when one or more sub-frame energy values are determined to be saturated. The first frame (m) may include four sub-frames, such as a first sub-frame (i), a second sub-frame (i+1), a third sub-frame (i+2), and a fourth sub-frame (i+3). Although the first frame (m) is illustrated as including 4 sub-frames, in other implementations, the first frame (m) may include more than or fewer than 4 sub-frames. A window (w) used to calculate sub-frame energy values $E_{S_{HB}}$ of a particular sub-frame may include a length of 100 samples. The 100 samples may include 80 samples from the particular sub-frame and 20 samples from a previous sub-frame (i−1) of a previous frame (m−1). In some implementations, the 20 frames from the previous sub-frame (i−1) may be stored in a memory that is coupled to the encoder 104 of FIG. 1 or the encoder 204 of FIG. 2.

A second graph 450 illustrates an overlapping window ($w^e$) used to determine a frame energy value $E_{S_{HB}}^{fr}$ of a first frame (m) that is used to check for saturation and that may be scaled when a frame energy value is determined to be saturated. The window ($w^{fr}$) of the first frame (m) may include 340 samples. The 340 samples may include 320 samples of the first frame (m) and 20 samples of a previous frame (m−1). In some implementations, the 20 frames from the previous frame (m−1) may be stored in a memory that is coupled to the encoder 104 of FIG. 1 or the encoder 204 of FIG. 2.

FIG. 5 depicts graphs that illustrate examples of audio signals. The graphs may be associated with the high band audio signal ($S_{HB}$) 140 of FIG. 1. A first graph 500 depicts a representation of the high band audio signal ($S_{HB}$) 140 output by the filter bank 120. The graph 530 depicts a representation of an output the high band audio signal ($S_{HB}$) 140 after the high band audio signal ($S_{HB}$) 140 has been encoded by the encoder 104 of FIG. 1 or the encoder 204 of FIG. 2 based one or more saturated energy values, such as a sub-frame energy value $E_{S_{HB}}^{fr}$ and a frame energy value $E_{S_{HB}}^{fr}$, and decoded by a decoder. It is noted that lower energy can be seen at 1:25:14 as compared to the representation of the high band audio signal ($S_{HB}$) 140 depicted in the first graph 500 due to information loss arising from saturation of energy values. A third graph 550 depicts a representation of an output the high band audio signal ($S_{HB}$) 140 output by a decoder after one or more saturated energy values, such as a sub-frame energy value $E_{S_{HB}}^{fr}$ and a frame energy value $E_{S_{HB}}^{fr}$, are corrected by the encoder 104 of FIG. 1 or the encoder 204 of FIG. 2. For example, the one or more saturated energy values may have been corrected by scaling the high band audio signal ($S_{HB}$) 140. It is noted that the energy at 1:25:14 has a similar magnitude as an energy of the original audio signal depicted in the first graph 500.

Referring to FIG. 6, a flow chart of a particular illustrative example of a method of operating an encoder is disclosed and generally designated 600. The encoder may include or correspond to the encoder 104 (e.g., the gain parameter circuitry 102, the scaling circuitry 124, the parameter determination circuitry 126) of FIG. 1, or the encoder 204 (e.g., the gain shape circuitry 230, the gain frame circuitry 236, or a combination thereof) of FIG. 2.

The method 600 includes receiving, at an encoder, a high band audio signal that includes a frame, the frame including multiple sub-frames, at 602. The high band audio signal may correspond to the high band audio signal ($S_{HB}$) 140 of FIG. 1. The high band audio signal may include a high band speech signal. In some implementations, the multiple sub-frames may include four sub-frames.

The method 600 also includes determining a number of sub-frames of the multiple sub-frames that are saturated, at 604. For example, the number of sub-frames that are saturated may correspond to the number of saturated sub-frames 262 of FIG. 1. Determining that a particular sub-frame of the multiple sub-frames is saturated may include determining that a number of bits needed or used to represent an energy value associated with the particular sub-frame exceeds a fixed-point width at the encoder.

The method 600 further includes determining, based on the number of sub-frames that are saturated, a gain frame parameter corresponding to the frame, at 606. The gain frame parameter may correspond to the one or more gain parameters 170 of FIG. 1 or the gain frame parameter 268 of FIG. 2. The gain frame parameter may be associated with a ratio that is based on the high band audio signal and a synthesized high band audio signal, such as the synthesized high band audio signal ($S_{HB}$) 150 of FIG. 1.

In some implementations, prior to determining the gain frame parameter, the method 600 may determine a particular energy value of the frame based on the high band audio signal. The particular energy value may correspond to a frame energy value $E_{S_{HB}}^{fr}$. A determination may be made whether the particular energy value is saturated. If the particular energy value is unsaturated, the particular energy value may be used calculate the gain frame parameter. Alternatively, if the particular energy value is determined to be saturated, a scaling factor may be determined that is based on the number of sub-frames that are saturated and the high band audio signal may be scaled based on the scaling factor to generate a scaled high band audio signal. After the scaled high band audio signal is generated, a second energy value of the frame may be determined based on the scaled high band audio signal.

To determine the gain frame parameter, a third energy value of the frame may be determined based on a synthesized high band audio signal. A particular value may be determined based on a ratio of the second energy value and the third energy value. In some implementations, the particular value may be equal to a square root of a ratio of the second energy value to the third energy value. The particular value may be multiplied by the scaling factor to generate the gain frame parameter.

In some implementations, the method 600 may include determining a gain shape parameter corresponding to the frame. For example, the gain shape parameter may correspond to the one or more gain parameters 170 of FIG. 1 or the gain shape parameter 264 of FIG. 2. The gain shape parameter may include a vector that includes an estimated value for each sub-frame of the multiple sub-frames. For each sub-frame, the estimated value may be associated with a ratio that is based on the high band audio signal and the synthesized high band audio signal.

In some implementations, for each sub-frame of the multiple sub-frames, a first energy value of the sub-frame may be determined based on the high band audio signal and a determination may be made whether the first energy value of the sub-frame is saturated. For each sub-frame of the multiple sub-frames that is determined to be unsaturated, the estimated gain shape value of the sub-frame may be determined based on a ratio of the first energy value and a second energy value of a corresponding sub-frame of the synthesized high band audio signal. Alternatively, for each sub-frame of the multiple sub-frames that is determined to be saturated, a portion of the high band audio signal that corresponds to the sub-frame may be scaled and a second energy value of the sub-frame based on the scaled portion of the high band audio signal may be determined. The second energy value may be set as the estimated value of the sub-frame. To illustrate, the portion of the high band audio signal may be scaled using a scaling factor. The scaling factor may correspond to a factor of two, as an illustrative, non-limiting example.

The determined gain shape parameter, such as the gain shape parameter 264, may be quantized. The gain shape parameter, such as the gain shape parameter 264 of FIG. 1, may be used to generate a gain shape compensated signal based on the quantized gain shape parameter and a synthesized high band signal. The gain shape compensated signal may correspond to the gain shape compensated synthesized high band audio signal 261 of FIG. 2. The gain frame parameter may be determined based on the gain shape compensated signal and a scaled version of the high band audio signal. The scaled version of the high band audio signal may be generated based on the high band audio signal and based on the number of sub-frames that are saturated. The scaled version of the high band audio signal may correspond to the scaled high band audio signal 160 of FIG. 1.

In some implementations, a determination may be made whether to scale the high band audio signal based on the number of sub-frames that are saturated. In response to a determination to scale the high band audio signal, the high band audio signal may be scaled according to a scaling factor to generate a second scaled high band audio signal, such as the scaled high band audio signal 160 of FIG. 1. For example, the second scaled high band audio signal may be generated in response to a determination that the number of sub-frames that are saturated is greater than zero. In some implementations, the scaling factor may be determined based on the number of sub-frames that are saturated.

In some implementations, the method 600 may include scaling the high band audio signal to generate a scaled high band audio signal. For example, the scaling circuitry 124 of FIG. 1, the gain shape circuitry 230 of FIG. 2 or FIG. 3, or the gain frame circuitry 236 of FIG. 2 or FIG. 3 may scale the high band audio signal ($S_{HB}$) 140 of FIG. 1. The method 600 may also include determining a gain shape parameter based on the scaled high band audio signal. For example, the gain shape circuitry 230 of FIG. 2 or FIG. 3 may determine the gain shape parameter 264.

The method 600 may thus enable the high band signal may be scaled prior to performing the energy calculation. Scaling the high band energy signal may avoid saturation of the high band signal and may reduce degradation of audio quality (associated with the high band signal) caused by attenuation. For example, scaling down by factor(s) of 2 (or 4, 8, etc.) may reduce the energy value of a frame or sub-frame to a quantity that can be presented using an available number of bits at an encoder.

Referring to FIG. 7, a flow chart of a particular illustrative example of a method of operating an encoder is disclosed and generally designated 700. The encoder may include or correspond to the encoder 104 (e.g., the gain parameter circuitry 102, the scaling circuitry 124, the parameter determination circuitry 126) of FIG. 1, or the encoder 204 (e.g., the gain shape circuitry 230, the gain frame circuitry 236, or a combination thereof) of FIG. 2.

The method 700 includes receiving, at an encoder, a high band audio signal, at 702. For example, the high band audio signal may correspond to the high band audio signal ($S_{HB}$) 140 of FIG. 1. The high band audio signal may include a high band speech signal.

The method 700 includes scaling the high band audio signal to generate a scaled high band audio signal, at 704. The scaled high band audio signal may correspond to the scaled high band audio signal 160 of FIG. 1.

The method 700 also includes determining a gain parameter based on the scaled high band audio signal, at 706. For example, the gain parameter may correspond to the one or more gain parameters 170 of FIG. 1, the gain shape parameter 264 of FIG. 2, the gain frame parameter 268 of FIG. 2, or a combination thereof.

In some implementations, the high band audio signal includes a frame having multiple sub-frames. Scaling the high band audio signal may include determining a scaling factor based on a number of saturated sub-frames of the frame, such as the number of saturated sub-frames 262 of FIG. 2. The scaling factor may be used to scale the high band audio signal.

In some implementations, the high band audio signal may be scaled using a predetermined value to generate the scaled high band audio signal. The predetermined value may correspond to a factor of 2 or a factor of 8, as illustrative, non-limiting examples. Additionally or alternatively, scaling the high band audio signal may include iteratively scaling the high band audio signal to generate the scaled high band audio signal.

In some implementations, the scaled high band audio signal may be generated in response to determining that a first energy value of the high band audio signal is saturated. Subsequent to the scaled high band audio signal being generated, a second energy value of the scaled high band audio signal may be generated and a determination of whether the scaled high band audio signal is saturated may be made based on the second energy value.

The method 700 may thus enable the encoder to scale the high band signal prior to performing the energy calculation. By scaling the high band energy signal, saturation of the high band signal may be avoided and degradation of audio quality (associated with the high band signal) caused by attenuation may be reduced. Additionally, by scaling the high band energy signal, the energy value of a frame or sub-frame may be reduced to a quantity that can be presented using an available number of bits at the encoder.

In particular aspects, the methods of FIGS. 6-7 may be implemented by a field-programmable gate array (FPGA) device, an application-specific integrated circuit (ASIC), a processing unit such as a central processing unit (CPU), a digital signal processor (DSP), a controller, another hardware device, firmware device, or any combination thereof. As an example, one or more of the methods of FIGS. 6-7, individually or in combination, may be performed by a processor that executes instructions, as described with respect to FIGS. 8 and 9. To illustrate, a portion of the method 600 of FIG. 6 may be combined with a second portion of the method 700 of FIG. 7. Additionally, one or more steps described with reference to the FIGS. 6-7, may be optional, may be performed at least partially concurrently, may be performed in a different order than shown or described, or a combination thereof.

Referring to FIG. 8, a block diagram of a particular illustrative example of a device (e.g., a wireless communication device) is depicted and generally designated 800. In various implementations, the device 800 may have more or fewer components than illustrated in FIG. 8. In an illustrative example, the device 800 may include the encoder 104 of FIG. 1 or the encoder 204 of FIG. 2. In an illustrative example, the device 800 may operate according to one or more of the methods of FIGS. 6-7.

In a particular implementation, the device 800 includes a processor 806 (e.g., a CPU). The device 800 may include one or more additional processors 810 (e.g., one or more DSPs). The processors 810 may include a speech and music coder-decoder (CODEC) 808 and an echo canceller 812. For example, the processors 810 may include one or more components (e.g., circuitry) configured to perform operations of the speech and music CODEC 808. As another example, the processors 810 may be configured to execute one or more computer-readable instructions to perform the operations of the speech and music CODEC 808. Although the speech and music CODEC 808 is illustrated as a component of the processors 810, in other examples one or more components of the speech and music CODEC 808 may be included in the processor 806, a CODEC 834, another processing component, or a combination thereof. The speech and music CODEC 808 may include an encoder 892, such as a vocoder encoder. For example, the encoder 892 may correspond to the encoder 104 of FIG. 1 or the encoder 204 of FIG. 2.

In a particular aspect, the encoder 892 may include a gain shape circuitry 894 and a gain frame circuitry 895 that are each configured to determine one or more gain frame parameters. For example, the gain shape circuitry 894 may correspond to gain parameter circuitry 102 of FIG. 1 or the gain shape circuitry 230 of FIG. 1. The gain frame circuitry 895 may correspond to the gain parameter circuitry 102 of FIG. 1 or the gain frame circuitry 236 of FIG. 2.

The device 800 may include a memory 832 and the CODEC 834. The CODEC 834 may include a digital-to-analog converter (DAC) 802 and an analog-to-digital converter (ADC) 804. A speaker 836, a microphone 838, or both may be coupled to the CODEC 834. The CODEC 834 may receive analog signals from the microphone 838, convert the analog signals to digital signals using the analog-to-digital converter 804, and provide the digital signals to the speech and music CODEC 808. The speech and music CODEC 808 may process the digital signals. In some implementations, the speech and music CODEC 808 may provide digital signals to the CODEC 834. The CODEC 834 may convert the digital signals to analog signals using the digital-to-analog converter 802 and may provide the analog signals to the speaker 836.

The device 800 may include a wireless controller 840 coupled, via a transceiver 850 (e.g., a transmitter, a receiver, or a combination thereof), to an antenna 842. The device 800 may include the memory 832, such as a computer-readable storage device. The memory 832 may include instructions 860, such as one or more instructions that are executable by the processor 806, the processor 810, or a combination thereof, to perform one or more of the methods of FIGS. 6-7.

As an illustrative example, the memory 832 may store instructions that, when executed by the processor 806, the processor 810, or a combination thereof, cause the processor 806, the processor 810, or a combination thereof, to perform operations including determining a number of sub-frames of multiple sub-frames that are saturated. The multiple sub-frames may be included in a frame of a high band audio signal. The operations may further include determining, based on the number of sub-frames that are saturated, a gain frame parameter corresponding to the frame.

In some implementations, the memory 832 may include code (e.g., interpreted or complied program instructions) that may be executed by the processor 806, the processor 810, or a combination thereof, to cause the processor 806, the processor 810, or a combination thereof, to perform functions as described with reference to the encoder 104 of FIG. 1 or the encoder 204 of FIG. 2, to perform at least a portion of one or more of the methods FIGS. 6-7, or a combination thereof. To further illustrate, Example 1 depicts illustrative pseudo-code (e.g., simplified C-code in floating point) that may be compiled and stored in the memory 832. The pseudo-code illustrates a possible implementation of aspects described with respect to FIGS. 1-7. The pseudo-code includes comments which are not part of the executable code. In the pseudo-code, a beginning of a comment is indicated by a forward slash and asterisk (e.g., "/*") and an end of the comment is indicated by an asterisk and a forward slash (e.g., "*/"). To illustrate, a comment "COMMENT" may appear in the pseudo-code as /* COMMENT */.

In the provided example, the "==" operator indicates an equality comparison, such that "A==B" has a value of TRUE when the value of A is equal to the value of B and has a value of FALSE otherwise. The "&&" operator indicates a logical AND operation. The "||" operator indicates a logical OR operation. The ">" (greater than) operator represents "greater than", the ">=" operator represents "greater than or equal to", and the "<" operator indicates "less than". The term "f" following a number indicates a floating point (e.g., decimal) number format.

In the provided example, "*" may represent a multiplication operation, "+" or "sum" may represent an addition operation, "−" may indicate a subtraction operation, and "/" may represent a division operation. The "=" operator represents an assignment (e.g., "a=1" assigns the value of 1 to the variable "a"). Other implementations may include one or more conditions in addition to or in place of the set of conditions of Example 1.

Example 1

```
oriNrg = L_deposit_l(0); /*oriNrg corresponds to E_{S_HB}^{fr}*/
synNrg = L_deposit_l(0); /*synNrg corresponds to Ê_{S_HB}^{fr}*/
FOR( i = −20; i <= 319; i++ )
{
        /* win_shb corresponds to w^{fr} and oriSHB
corresponds to S_HB*/
    sig = ( oriSHB[i] * win_shb[i] );
    /* oriNrg = oriNrg + sig*sig */
        oriNrg = L_mac0( oriNrg, sig, sig );
    /*mod_syn corresponds to Ŝ_HB*/
        sig = round_fx( Mult_32_16( mod_syn[i],
win_shb[i] ) );
        /* synNrg = synNrg + sig*sig */
    synNrg = L_mac0( synNrg, sig, sig );
}
Log2_Factor = 0; /*log_2(Factor)*/
/*Initialize Factor = 1, meaning Log2_Factor = 0*/
IF(oriNrg == MAX_32) /*meaning oriNrg saturated at 2^31 −
1*/
{
/*n_subfr_saturation is the number of saturated sub-frame
energies of oriSHB in GainShape calculation*/
        Log2_Factor = ( (n_subfr_saturation/2) + 1);
        oriNrg = 0;
    /* Re-calculate oriNrg */
        FOR( i = −20; i <= 319; i++ )
            {
                sig = ( (oriSHB[i]/pow(2,
    Log2_Factor) * win_shb[i] ) );
```

-continued

```
                    /*Above, oriSHB[i] is scaled by
2^Log2_Factor = Factor*/
                    oriNrg = L_mac0( oriNrg, sig, sig );
                }
    }
GainFrame = pow(2, Log2_Factor) * sqrt(oriNrg/synNrg);
```

The memory 832 may include instructions 860 executable by the processor 806, the processors 810, the CODEC 834, another processing unit of the device 800, or a combination thereof, to perform methods and processes disclosed herein, such as one or more of the methods of FIGS. 6-7. One or more components of the system 100 of FIG. 1, the system 200 of FIG. 2, or the system 300 of FIG. 3 may be implemented via dedicated hardware (e.g., circuitry), by a processor executing instructions (e.g., the instructions 860) to perform one or more tasks, or a combination thereof. As an example, the memory 832 or one or more components of the processor 806, the processors 810, the CODEC 834, or a combination thereof, may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 860) that, when executed by a computer (e.g., a processor in the CODEC 834, the processor 806, the processors 810, or a combination thereof), may cause the computer to perform at least a portion of one or more of the methods of FIGS. 6-7. As an example, the memory 832 or the one or more components of the processor 806, the processors 810, the CODEC 834 may be a non-transitory computer-readable medium that includes instructions (e.g., the instructions 860) that, when executed by a computer (e.g., a processor in the CODEC 834, the processor 806, the processors 810, or a combination thereof), cause the computer perform at least a portion of one or more of the methods FIGS. 6-7.

In a particular implementation, the device 800 may be included in a system-in-package or system-on-chip device 822. In some implementations, the memory 832, the processor 806, the processors 810, the display controller 826, the CODEC 834, the wireless controller 840, and the transceiver 850 are included in a system-in-package or system-on-chip device 822. In some implementations, an input device 830 and a power supply 844 are coupled to the system-on-chip device 822. Moreover, in a particular implementation, as illustrated in FIG. 8, the display 828, the input device 830, the speaker 836, the microphone 838, the antenna 842, and the power supply 844 are external to the system-on-chip device 822. In other implementations, each of the display 828, the input device 830, the speaker 836, the microphone 838, the antenna 842, and the power supply 844 may be coupled to a component of the system-on-chip device 822, such as an interface or a controller of the system-on-chip device 822. In an illustrative example, the device 800 corresponds to a communication device, a mobile communication device, a smartphone, a cellular phone, a laptop computer, a computer, a tablet computer, a personal digital assistant, a set top box, a display device, a television, a gaming console, a music player, a radio, a digital video player, a digital video disc (DVD) player, an optical disc player, a tuner, a camera, a navigation device, a decoder system, an encoder system, a base station, a vehicle, or any combination thereof.

In an illustrative example, the processors 810 may be operable to perform all or a portion of the methods or operations described with reference to FIGS. 1-7. For example, the microphone 838 may capture an audio signal corresponding to a user speech signal. The ADC 804 may convert the captured audio signal from an analog waveform into a digital waveform comprised of digital audio samples. The processors 810 may process the digital audio samples. The echo canceller 812 may reduce an echo that may have been created by an output of the speaker 836 entering the microphone 838.

The encoder 892 (e.g., a vocoder encoder) of the speech and music CODEC 808 may compress digital audio samples corresponding to the processed speech signal and may form a sequence of packets (e.g. a representation of the compressed bits of the digital audio samples). The sequence of packets may be stored in the memory 832. The transceiver 850 may modulate each packet of the sequence and may transmit the modulated data via the antenna 842.

As a further example, the antenna 842 may receive incoming packets corresponding to a sequence of packets sent by another device via a network. The incoming packets may include an audio frame (e.g., an encoded audio frame). The decoder may decompress and decode the receive packet to generate reconstructed audio samples (e.g., corresponding to a synthesized audio signal). The echo canceller 812 may remove echo from the reconstructed audio samples. The DAC 802 may convert an output of the decoder from a digital waveform to an analog waveform and may provide the converted waveform to the speaker 836 for output.

Referring to FIG. 9, a block diagram of a particular illustrative example of a base station 900 is depicted. In various implementations, the base station 900 may have more components or fewer components than illustrated in FIG. 9. In an illustrative example, the base station 900 may include the device 102 of FIG. 1. In an illustrative example, the base station 900 may operate according to one or more of the methods of FIGS. 5-6, one or more of the Examples 1-5, or a combination thereof The base station 900 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1X, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 800 of FIG. 8.

Various functions may be performed by one or more components of the base station 900 (and/or in other components not shown), such as sending and receiving messages and data (e.g., audio data). In a particular example, the base station 900 includes a processor 906 (e.g., a CPU). The base station 900 may include a transcoder 910. The transcoder 910 may include a speech and music 908. For example, the transcoder 910 may include one or more components (e.g., circuitry) configured to perform operations of the speech and music CODEC 908. As another example, the transcoder 910 may be configured to execute one or more computer-readable instructions to perform the operations of the speech and music CODEC 908. Although the speech and music CODEC 908 is illustrated as a component of the transcoder 910, in other examples one or more components of the speech and music CODEC 908 may be included in the processor 906, another processing component, or a combination thereof. For example, a decoder 938 (e.g., a vocoder decoder) may be included in a receiver data processor 964. As another example, an encoder 936 (e.g., a vocoder encoder) may be included in a transmission data processor 966.

The transcoder 910 may function to transcode messages and data between two or more networks. The transcoder 910 may be configured to convert message and audio data from a first format (e.g., a digital format) to a second format. To illustrate, the decoder 938 may decode encoded signals having a first format and the encoder 936 may encode the decoded signals into encoded signals having a second format. Additionally or alternatively, the transcoder 910 may be configured to perform data rate adaptation. For example, the transcoder 910 may downconvert a data rate or upconvert the data rate without changing a format the audio data. To illustrate, the transcoder 910 may downconvert 64 kbit/s signals into 16 kbit/s signals.

The speech and music CODEC 908 may include the encoder 936 and the decoder 938. The encoder 936 may include gain shape circuitry and gain frame circuitry, as described with reference to FIG. 8. The decoder 938 may include gain shape circuitry and gain frame circuitry.

The base station 900 may include a memory 932. The memory 932, such as a computer-readable storage device, may include instructions. The instructions may include one or more instructions that are executable by the processor 906, the transcoder 910, or a combination thereof, to perform one or more of the methods of FIGS. 5-6, the Examples 1-5, or a combination thereof. The base station 900 may include multiple transmitters and receivers (e.g., transceivers), such as a first transceiver 952 and a second transceiver 954, coupled to an array of antennas. The array of antennas may include a first antenna 942 and a second antenna 944. The array of antennas may be configured to wirelessly communicate with one or more wireless devices, such as the device 800 of FIG. 8. For example, the second antenna 944 may receive a data stream 914 (e.g., a bit stream) from a wireless device. The data stream 914 may include messages, data (e.g., encoded speech data), or a combination thereof.

The base station 900 may include a network connection 960, such as backhaul connection. The network connection 960 may be configured to communicate with a core network or one or more base stations of the wireless communication network. For example, the base station 900 may receive a second data stream (e.g., messages or audio data) from a core network via the network connection 960. The base station 900 may process the second data stream to generate messages or audio data and provide the messages or the audio data to one or more wireless device via one or more antennas of the array of antennas or to another base station via the network connection 960. In a particular implementation, the network connection 960 may be a wide area network (WAN) connection, as an illustrative, non-limiting example.

The base station 900 may include a demodulator 962 that is coupled to the transceivers 952, 954, the receiver data processor 964, and the processor 906, and the receiver data processor 964 may be coupled to the processor 906. The demodulator 962 may be configured to demodulate modulated signals received from the transceivers 952, 954 and to provide demodulated data to the receiver data processor 964. The receiver data processor 964 may be configured to extract a message or audio data from the demodulated data and send the message or the audio data to the processor 906.

The base station 900 may include a transmission data processor 966 and a transmission multiple input-multiple output (MIMO) processor 968. The transmission data processor 966 may be coupled to the processor 906 and the transmission MIMO processor 968. The transmission MIMO processor 968 may be coupled to the transceivers 952, 954 and the processor 906. The transmission data processor 966 may be configured to receive the messages or the audio data from the processor 906 and to code the messages or the audio data based on a coding scheme, such as CDMA or orthogonal frequency-division multiplexing (OFDM), as an illustrative, non-limiting examples. The transmission data processor 966 may provide the coded data to the transmission MIMO processor 968.

The coded data may be multiplexed with other data, such as pilot data, using CDMA or OFDM techniques to generate multiplexed data. The multiplexed data may then be modulated (i.e., symbol mapped) by the transmission data processor 966 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 906.

The transmission MIMO processor 968 may be configured to receive the modulation symbols from the transmission data processor 966 and may further process the modulation symbols and may perform beamforming on the data. For example, the transmission MIMO processor 968 may apply beamforming weights to the modulation symbols. The beamforming weights may correspond to one or more antennas of the array of antennas from which the modulation symbols are transmitted.

During operation, the second antenna 944 of the base station 900 may receive a data stream 914. The second transceiver 954 may receive the data stream 914 from the second antenna 944 and may provide the data stream 914 to the demodulator 962. The demodulator 962 may demodulate modulated signals of the data stream 914 and provide demodulated data to the receiver data processor 964. The receiver data processor 964 may extract audio data from the demodulated data and provide the extracted audio data to the processor 906.

The processor 906 may provide the audio data to the transcoder 910 for transcoding. The decoder 938 of the transcoder 910 may decode the audio data from a first format into decoded audio data and the encoder 936 may encode the decoded audio data into a second format. In some implementations, the encoder 936 may encode the audio data using a higher data rate (e.g., upconvert) or a lower data rate (e.g., downconvert) than received from the wireless device.

In other implementations the audio data may not be transcoded. Although transcoding (e.g., decoding and encoding) is illustrated as being performed by a transcoder 910, the transcoding operations (e.g., decoding and encoding) may be performed by multiple components of the base station 900. For example, decoding may be performed by the receiver data processor 964 and encoding may be performed by the transmission data processor 966.

The decoder 938 and the encoder 936 may determine, on a frame-by-frame basis, a gain shape parameter corresponding to the frame, a gain frame parameter corresponding to the frame, or both. The gain shape parameter, the gain frame parameter, or both may be used to generate a synthesized high band signal. Encoded audio data generated at the encoder 936, such as transcoded data, may be provided to the transmission data processor 966 or the network connection 960 via the processor 906.

The transcoded audio data from the transcoder 810 may be provided to the transmission data processor 966 for coding according to a modulation scheme, such as OFDM, to generate the modulation symbols. The transmission data processor 966 may provide the modulation symbols to the transmission MIMO processor 968 for further processing and beamforming. The transmission MIMO processor 968 may apply beamforming weights and may provide the modulation symbols to one or more antennas of the array of antennas, such as the first antenna 942 via the first transceiver 952. Thus, the base station 900 may provide a transcoded data stream 916, that corresponds to the data stream 914 received from the wireless device, to another wireless device. The transcoded data stream 916 may have a different encoding format, data rate, or both, than the data stream 914. In other implementations, the transcoded data stream 916 may be provided to the network connection 960 for transmission to another base station or a core network.

The base station 900 may therefore include a computer-readable storage device (e.g., the memory 932) storing instructions that, when executed by a processor (e.g., the processor 906 or the transcoder 910), cause the processor to perform operations including determining a number of sub-frames of multiple sub-frames that are saturated. The multiple sub-frames may be included in a frame of a high band audio signal. The operations may further include determining, based on the number of sub-frames that are saturated, a gain frame parameter corresponding to the frame.

In conjunction with the described aspects, an apparatus may include means for receiving a high band audio signal that includes a frame, the frame including multiple sub-frames. For example, the means for receiving a high band audio signal may include or correspond to encoder 104, the filter bank 120, the synthesizer 122, the gain parameter circuitry, the scaling circuitry 124, the parameter determination circuitry 126 of FIG. 1, the encoder 204, the gain shape circuitry 230, the gain frame circuitry 236 of FIG. 2, the LP analysis and quantization circuitry 312 of FIG. 3, the antenna 842, the transceiver 850, the wireless controller 840, the speech and music CODEC 808, the encoder 892, the gain shape circuitry 894, the gain frame circuitry 895, the CODEC 834, the microphone 838, one or more of the processors 810, 806 programmed to execute the instructions 860 of FIG. 8, the processor 906 or the transcoder 910 of FIG. 9, one or more other structures, devices, circuits, modules, or instructions to receive the high band audio signal, or a combination thereof.

The apparatus may also include means for determining a number of sub-frames of the multiple sub-frames that are saturated. For example, the means for determining the number of sub-frames may include or correspond to the encoder 104, the gain parameter circuitry 102, the scaling circuitry 124, the parameter determination circuitry 126 of FIG. 1, the encoder 204, the gain shape circuitry 230, the gain frame circuitry 236 of FIG. 2, the speech and music CODEC 808, the CODEC 834, the encoder 892, one or more of the processors 810, 806 programmed to execute the instructions 860 of FIG. 8, a counter, the processor 906 or the transcoder 910 of FIG. 9, one or more other structures, devices, circuits, modules, or instructions to determine the number of sub-frames, or a combination thereof.

The apparatus may also include means for determining a gain frame parameter corresponding to the frame. The gain frame parameter may be determined based on the number of sub-frames that are saturated. For example, the means for determining the gain frame parameter may include or correspond to the encoder 104, the gain parameter circuitry 102, the parameter determination circuitry 126 of FIG. 1, the encoder 204, the gain shape circuitry 230, the gain frame circuitry 236 of FIG. 2, the speech and music CODEC 808, the CODEC 834, the encoder 892, one or more of the processors 810, 806 programmed to execute the instructions 860 of FIG. 8, the processor 906 or the transcoder 910 of FIG. 9, one or more other structures, devices, circuits, modules, or instructions to output the second decoded speech, or a combination thereof.

The apparatus may also include means for generating a synthesized signal based on the high band audio signal. For example, the means for generating a synthesized signal may include or correspond to the encoder 104, the synthesizer 122 of FIG. 1, the encoder 204 of FIG. 2, the speech and music CODEC 808, the CODEC 834, the encoder 892, one or more of the processors 810, 806 programmed to execute the instructions 860 of FIG. 8, the processor 906 or the transcoder 910 of FIG. 9, one or more other structures, devices, circuits, modules, or instructions to generate the synthesized signal, or a combination thereof.

The apparatus may also include means for iteratively scaling the high band audio signal to generate a scaled high band audio signal. For example, the means for iteratively scaling the high band audio signal may include or correspond to encoder 104, the gain parameter circuitry 102, the parameter determination circuitry 126 of FIG. 1, the encoder 204, the gain shape circuitry 230, the gain frame circuitry 236 of FIG. 2, the speech and music CODEC 808, the CODEC 834, the encoder 892, one or more of the processors 810, 806 programmed to execute the instructions 860 of FIG. 8, the processor 906 or the transcoder 910 of FIG. 9, one or more other structures, devices, circuits, modules, or instructions to iteratively scale the high band audio signal, or a combination thereof.

The apparatus may also include means for generating a first scaled synthesized signal. For example, the means for generating the first scaled synthesized signal may include or correspond to encoder 104, the gain parameter circuitry 102, the parameter determination circuitry 126 of FIG. 1, the encoder 204, the gain frame circuitry 236 of FIG. 2, the speech and music CODEC 808, the CODEC 834, the encoder 892, one or more of the processors 810, 806 programmed to execute the instructions 860 of FIG. 8, the processor 906 or the transcoder 910 of FIG. 9, one or more other structures, devices, circuits, modules, or instructions to generate a scaled synthesized signal, or a combination thereof.

The apparatus may also include means for determining a gain shape parameter based on the first scaled synthesized signal. For example, the means for determining the gain shape parameter based on the first scaled synthesized signal may include or correspond to encoder 104, the gain parameter circuitry 102, the parameter determination circuitry 126 of FIG. 1, the encoder 204, the gain shape circuitry 230, the gain frame circuitry 236 of FIG. 2, the speech and music CODEC 808, the CODEC 834, the encoder 892, one or more of the processors 810, 806 programmed to execute the instructions 860 of FIG. 8, the processor 906 or the transcoder 910 of FIG. 9, one or more other structures, devices, circuits, modules, or instructions to determine a gain shape parameter based on a scaled synthesized signal, or a combination thereof.

In some implementations, the means for receiving comprises a filter bank, the means for determining the number of sub-frames comprises gain shape circuitry, and the means for determining the gain frame comprises gain frame circuitry.

In some implementations, the means for receiving the high band audio signal, the means for determining the number of sub-frames, and the means for determining a gain frame parameter each comprise a processor and a memory storing instructions that are executable by the processor. Additionally or alternatively, the means for receiving the high band audio signal, the means for determining the number of sub-frames, and the means for determining the gain frame parameter are integrated into an encoder, a set top box, a music player, a video player, an entertainment unit, a navigation device, a communications device, a personal digital assistant (PDA), a computer, or a combination thereof.

In the aspects of the description described above, various functions performed have been described as being performed by certain circuitry or components, such as circuitry or components of the system 100 of FIG. 1, the system 200 of FIG. 2, the system 300 of FIG. 3, the device 800 of FIG. 8, the base station 900 of FIG. 9, or a combination thereof. However, this division of circuitry and components is for illustration only. In alternative examples, a function performed by a particular circuit or component may instead be divided amongst multiple circuits or components. Moreover, in other alternative examples, two or more circuits or components of FIGS. 1-3 may be integrated into a single circuit or component. Each circuit and component illustrated in FIGS. 1-3, 8, and 9 may be implemented using hardware (e.g., an ASIC, a DSP, a controller, a FPGA device, etc.), software (e.g., logic, modules, instructions executable by a processor, etc.), or any combination thereof.

Those of skill would further appreciate that the various illustrative logical blocks, configurations, modules, circuits, and algorithm steps described in connection with the aspects disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, such implementation decisions are not to be interpreted as causing a departure from the scope of the present disclosure.

The steps of a method or algorithm described in connection with the aspects disclosed herein may be included directly in hardware, in a software module executed by a processor, or in a combination of the two. A software module may reside in RAM, flash memory, ROM, PROM, EPROM, EEPROM, registers, hard disk, a removable disk, a CD-ROM, or any other form of non-transient storage medium known in the art. A particular storage medium may be coupled to the processor such that the processor may read information from, and write information to, the storage medium. In the alternative, the storage medium may be integral to the processor. The processor and the storage medium may reside in an ASIC. The ASIC may reside in a computing device or a user terminal. In the alternative, the processor and the storage medium may reside as discrete components in a computing device or user terminal.

The previous description is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein and is to be accorded the widest scope possible consistent with the principles and novel features as defined by the following claims.

What is claimed is:

1. A device for generating a gain frame parameter for producing a bit stream comprising:

a synthesizer configured to generate a synthesized high band audio signal based on a high band audio signal;

gain shape circuitry configured to:

determine a number of sub-frames of multiple sub-frames that are saturated, the multiple sub-frames included in a frame of the high band audio signal; and determine a gain shape parameter based on a first ratio associated with the high band audio signal and the synthesized high band audio signal; and gain frame circuitry configured to:

determine the gain frame parameter corresponding to the frame based on the number of sub-frames that are saturated and based on a second ratio associated with the high band audio signal and the synthesized high band audio signal; and a transceiver configured to output the bit stream based on the gain frame parameter.

2. The device of claim 1, wherein the gain shape circuitry is further configured to determine a particular energy value of the frame based on the high band audio signal and to determine whether the particular energy value is saturated based on a number of bits needed to represent the particular energy value.

3. The device of claim 1, further comprising a gain shape compensator configured to generate a compensated synthesized high band audio signal based on the synthesized high band audio signal and based on the gain shape parameter, wherein the gain frame circuitry is configured to generate the gain frame parameter further based on the compensated synthesized high band audio signal.

4. The device of claim 1, further comprising:

an encoder configured to receive an input audio signal and to generate an output signal based on data indicative of the gain frame parameter, the encoder including the gain shape circuitry and the gain frame circuitry; and a filter configured to generate the high band audio signal based on the input audio signal.

5. The device of claim 1, wherein the gain shape circuitry, the gain frame circuitry, or both, are further configured to generate a scaled high band audio signal based on the high band audio signal.

6. The device of claim 1, wherein the gain frame circuitry is further configured to iteratively scale the high band audio signal to generate a scaled high band audio signal.

7. The device of claim 1, further comprising scaling circuitry configured to iteratively scale the high band audio signal to generate a scaled high band audio signal.

8. The device of claim 1, further comprising an encoder, wherein the gain shape circuitry, the gain frame circuitry, and the encoder are integrated into a mobile communication device or a base station.

9. The device of claim 1, further comprising:

a receiver configured to receive the high band audio signal that includes the frame;

a demodulator coupled to the receiver, the demodulator configured to demodulate the high band audio signal;

a processor coupled to the demodulator; and a decoder.

10. The device of claim 9, wherein the receiver, the demodulator, the processor, and the decoder are integrated into a mobile communication device.

11. The device of claim 9, wherein the receiver, the demodulator, the processor, and the decoder are integrated into a base station.

12. The device of claim 1, further comprising a transmitter configured to transmit data indicative of the gain frame parameter to another device.

13. The device of claim 12, wherein the data indicative of the gain frame parameter is configured to be utilized by a decoder of the other device to generate a reconstructed high band audio signal that corresponds to the high band audio signal.

14. A method of generating a gain frame parameter for producing a bit stream comprising:

receiving, at an encoder, a high band audio signal that includes a frame, the frame including multiple sub-frames;

determining a number of sub-frames of the multiple sub-frames that are saturated;

generating a synthesized high band audio signal based on the high band audio signal;

determine a gain shape parameter based on a first ratio associated with the high band audio signal and the synthesized high band audio signal;

determining the gain frame parameter corresponding to the frame based on the number of sub-frames that are saturated and based on a second ratio associated with the high band audio signal and the synthesized high band audio signal; and generating the bit stream based on the gain frame parameter.

15. The method of claim 14, wherein determining that a particular sub-frame of the multiple sub-frames is saturated comprises determining, at the encoder, that a number of bits needed to represent an energy value associated with the particular sub-frame exceeds a fixed-point width of the encoder.

16. The method of claim 14, further comprising, prior to determining the gain frame parameter:

determining a particular energy value of the frame based on the high band audio signal; and determining whether the particular energy value is saturated based on a number of bits needed to represent the particular energy value.

17. The method of claim 16, wherein the particular energy value is saturated when the number of bits needed to represent the particular energy value is greater than a total number of bits of the encoder available to store the particular energy value.

18. The method of claim 16, further comprising in response to determining that the particular energy value is saturated:

determining a scaling factor based on the number of sub-frames that are saturated;

scaling the high band audio signal based on the scaling factor to generate a scaled high band audio signal; and determining a second energy value of the frame based on the scaled high band audio signal.

19. The method of claim 18, wherein determining the gain frame parameter comprises:

determining a third energy value of the frame based on the synthesized high band audio signal;

determining a particular value based on a ratio of the second energy value and the third energy value; and multiplying the particular value by the scaling factor to generate the gain frame parameter.

20. The method of claim 14, wherein the high band audio signal comprises a high band speech signal.

21. The method of claim 14, further comprising:

scaling the high band audio signal to generate a scaled high band audio signal; and determining the gain shape parameter based further on the scaled high band audio signal.

22. The method of claim 14, wherein the gain shape parameter comprises a vector that includes an estimated gain shape value for each sub-frame of the multiple sub-frames.

23. The method of claim 22, further comprising, for each sub-frame of the multiple sub-frames:

determining a first energy value of the sub-frame based on the high band audio signal; and determining whether the first energy value of the sub-frame is saturated.

24. The method of claim 23, further comprising, for each sub-frame of the multiple sub-frames that is determined to be unsaturated, determining the estimated gain shape value of the sub-frame based on a ratio of the first energy value and a second energy value of a corresponding sub-frame of a synthesized high band audio signal.

25. The method of claim 23, further comprising, for each sub-frame of the multiple sub-frames that is determined to be saturated:

scaling a portion of the high band audio signal that corresponds to the sub-frame by a scaling factor;

determining a second energy value of the sub-frame based on the scaled portion of the high band audio signal;

determining a third energy value of a corresponding sub-frame of a synthesized high band audio signal;

determining a particular value based on a ratio of the second energy value and the third energy value; and multiplying the particular value by the scaling factor to generate the estimated gain shape value for the sub-frame.

26. The method of claim 25, further comprising retrieving the scaling factor from a memory, wherein the scaling factor corresponds to a factor of two.

27. The method of claim 14, further comprising generating a scaled synthesized signal based on the synthesized high band audio signal, and wherein the gain shape parameter is further based on the scaled synthesized signal.

28. The method of claim 22, further comprising:
quantizing the gain shape parameter;
and
generating a gain shape compensated signal based on the quantized gain shape parameter and the synthesized high band audio signal.

29. The method of claim 28, wherein the gain frame parameter is further determined based on the gain shape compensated signal and a scaled version of the high band audio signal, the scaled version of the high band audio signal generated based on the high band audio signal and based on the number of sub-frames that are saturated.

30. The method of claim 14, further comprising determining whether to scale the high band audio signal based on the number of sub-frames that are saturated.

31. The method of claim 30, further comprising scaling the high band audio signal in response to a determination that the number of sub-frames that are saturated in the high band audio signal is greater than zero.

32. The method of claim 14, further comprising:
determining a scaling factor based on the number of sub-frames that are saturated; and
scaling the high band audio signal based on the scaling factor to generate a scaled high band audio signal.

33. The method of claim 14, wherein the encoder is included in a device that comprises a mobile communication device or a base station.

34. An apparatus for generating a gain frame parameter for producing a bit stream, the apparatus comprising:
means for receiving a high band audio signal that includes a frame, the frame including multiple sub-frames;
means for determining a number of sub-frames of the multiple sub-frames that are saturated;
means for generating a synthesized signal based on the high band audio signal;
means for determining a gain shape parameter based on a first ratio associated with the high band audio signal and the synthesized signal;
means for determining the gain frame parameter corresponding to the frame based on the number of sub-frames that are saturated and based on a second ratio associated with the high band audio signal and the synthesized signal; and
means for generating the bit stream based on the gain frame parameter.

35. The apparatus of claim 34, further comprising:
means for generating a first scaled synthesized signal based on the synthesized signal.

36. The apparatus of claim 34, wherein the means for receiving comprises a filter bank, wherein the means for determining the number of sub-frames comprises gain shape circuitry, and wherein the means for determining the gain frame parameter comprises gain frame circuitry.

37. The apparatus of claim 34, further comprising means for iteratively scaling the high band audio signal to generate a scaled high band audio signal, wherein the gain frame parameter is further based on the scaled high band audio signal.

38. The apparatus of claim 34, wherein the means for receiving the high band audio signal, the means for determining the number of sub-frames, and the means for determining the gain frame parameter are integrated into at least one of an encoder, a set top box, a music player, a video player, an entertainment unit, a navigation device, a mobile communications device, a personal digital assistant (PDA), or a computer.

39. The apparatus of claim 34, wherein the means for receiving the high band audio signal, the means for determining the number of sub-frames, and the means for determining the gain frame parameter are integrated into a base station.

40. A computer-readable storage device storing instructions that, when executed by a processor, cause the processor to perform a method of generating a gain frame parameter for producing a bit stream comprising:
determining a number of sub-frames of multiple sub-frames that are saturated, the multiple sub-frames included in a frame of a high band audio signal;
generating a synthesized signal based on the high band audio signal;
determine a gain shape parameter based on a first ratio associated with the high band audio signal and the synthesized signal;
determining a gain frame parameter corresponding to the frame based on the number of sub-frames that are saturated and based on a second ratio associated with the high band audio signal and the synthesized signal; and
generating the bit stream based on the gain frame parameter.

41. The computer-readable storage device of claim 40, wherein the high band audio signal comprises a high band speech signal, and wherein the multiple sub-frames comprise four sub-frames.

42. The computer-readable storage device of claim 40, wherein the operations further comprise:
generating a first scaled synthesized signal based on the synthesized signal; and wherein
the gain shape parameter is further based on the first scaled synthesized signal.

43. A method of generating a gain frame parameter for producing a bit stream, comprising:
receiving, at an encoder, a high band audio signal including a frame that includes multiple sub-frames;
scaling, using a scaling factor determined based on a number of saturated sub-frames of the multiple sub-frames, the high band audio signal to generate a scaled high band audio signal;
generating a synthesized high band audio signal based on the high band audio signal;
determining a gain parameter based on a first ratio associated with the scaled high band audio signal and the synthesized high band audio signal;
determining the gain frame parameter based on the number of sub-frames that are saturated and based on a second ratio associated with the high band audio signal and the scaled high band audio signal; and
generating the bit stream based on the gain parameter.

44. The method of claim 43, wherein the gain parameter comprises a gain shape parameter, a gain frame parameter, or both, and further comprising transmitting data indicative of the gain parameter to another device.

45. The method of claim 43, wherein scaling the high band audio signal comprises iteratively scaling the high band audio signal to generate the scaled high band audio signal.

46. The method of claim 43, wherein the scaled high band audio signal is generated in response to determining that a first energy value of the high band audio signal is saturated, and further comprising, after the scaled high band audio signal is generated:
determining a second energy value of the scaled high band audio signal; and determining whether the scaled high band audio signal is saturated based on the second energy value.

47. The method of claim 43, wherein the encoder is included in a device that comprises a mobile communication device or a base station.

* * * * *